US008820621B2

(12) United States Patent
Burke et al.

(10) Patent No.: US 8,820,621 B2
(45) Date of Patent: Sep. 2, 2014

(54) BLANK AND METHODS OF CONSTRUCTING A FOOD HOLDER FROM THE BLANK

(75) Inventors: Bradley John Burke, Elmhurst, IL (US); Rachel K. Mortenson, Elmhurst, IL (US)

(73) Assignee: Graphic Packaging International, Inc., Atlanta, GA (US)

( * ) Notice: Subject to any disclaimer, the term of this patent is extended or adjusted under 35 U.S.C. 154(b) by 1612 days.

(21) Appl. No.: 11/690,445

(22) Filed: Mar. 23, 2007

(65) Prior Publication Data

US 2007/0221717 A1 Sep. 27, 2007

Related U.S. Application Data

(60) Provisional application No. 60/786,186, filed on Mar. 27, 2006.

(51) Int. Cl.
*B65D 5/00* (2006.01)
*B65D 43/16* (2006.01)

(52) U.S. Cl.
USPC ..... 229/146; 229/160.1

(58) Field of Classification Search
USPC ..... 229/146, 160.1, 114, 103, 904, 902, 229/906, 87.08, 938, 107; 426/113, 115
See application file for complete search history.

(56) References Cited

U.S. PATENT DOCUMENTS 2,296,389 A * 9/1942 Levkoff ..... 229/117.13
2,749,245 A * 6/1956 Leo ..... 426/108
3,391,782 A * 7/1968 Kaspar ..... 426/115
3,446,416 A 5/1969 Epstein
3,541,599 A * 11/1970 Roberts et al. ..... 206/457
3,610,512 A * 10/1971 Hermalin ..... 229/117
3,658,235 A * 4/1972 Katzenmayer et al. ..... 229/148
3,659,773 A * 5/1972 Manizza ..... 229/148
3,899,119 A * 8/1975 Roccaforte ..... 206/562
4,260,099 A * 4/1981 Mode ..... 229/101
4,494,785 A 1/1985 Song
4,511,039 A * 4/1985 Siemek ..... 206/525
4,570,845 A * 2/1986 Hall ..... 229/146
4,572,423 A * 2/1986 Spencer ..... 206/562
4,585,124 A 4/1986 Pride
4,586,648 A * 5/1986 Josefsson et al. ..... 229/114
4,760,950 A 8/1988 Levick
4,844,330 A * 7/1989 Roosa et al. ..... 229/120.06
4,877,178 A * 10/1989 Eisman ..... 229/114
4,930,681 A * 6/1990 Fultz et al. ..... 229/114
(Continued)

*Primary Examiner* — Gary Elkins
*Assistant Examiner* — Christopher Demeree
(74) *Attorney, Agent, or Firm* — Womble Carlyle Sandridge & Rice, LLP

(57) ABSTRACT

A food holder for retaining a food product is provided. The food holder is formed from a continuous blank of sheet material. The food holder includes a top tray including a center panel, a side panel, and an end panel coupled together along a plurality of fold lines. The food holder further includes a bottom tray including a center panel, a side panel, and an end panel coupled together along a plurality of fold lines. The bottom tray is rotatably coupled to the top tray along a hinge line. The top tray is rotatable relative to the bottom tray from an open position to a closed position. The food holder further includes a moveable section including a portion of at least one of the top tray side panel and the bottom tray side panel. The moveable section facilitates movement of the top tray relative to the bottom tray for retaining the food product.

31 Claims, 13 Drawing Sheets

(56) References Cited

U.S. PATENT DOCUMENTS

| | | | | | |
|---|---|---|---|---|---|
| 4,940,190 | A | | 7/1990 | Groves | |
| 4,955,527 | A | * | 9/1990 | Blackman et al. | 229/114 |
| D314,887 | S | | 2/1991 | Tomaras | |
| 5,000,374 | A | * | 3/1991 | Deiger | 229/109 |
| 5,037,026 | A | * | 8/1991 | Hanko | 229/125.29 |
| D322,759 | S | | 12/1991 | Groves | |
| 5,071,062 | A | * | 12/1991 | Bradley et al. | 229/109 |
| 5,110,038 | A | * | 5/1992 | Pantisano et al. | 229/103 |
| 5,181,649 | A | | 1/1993 | Frost | |
| 5,188,284 | A | * | 2/1993 | Eisman | 229/110 |
| 5,205,476 | A | * | 4/1993 | Sorenson | 229/114 |
| 5,375,761 | A | * | 12/1994 | Sullivan et al. | 229/100 |
| 5,388,758 | A | * | 2/1995 | Scovell | 229/146 |
| 5,421,508 | A | | 6/1995 | Beales | |
| 5,431,333 | A | * | 7/1995 | Lorenz | 229/114 |
| 5,476,215 | A | | 12/1995 | Baroud | |
| 5,522,537 | A | * | 6/1996 | Barlow | 229/109 |
| 5,538,179 | A | * | 7/1996 | Cai | 229/125 |
| 5,553,772 | A | * | 9/1996 | Jensen | 229/148 |
| 5,632,379 | A | | 5/1997 | Frost | |
| 5,788,145 | A | * | 8/1998 | Grahahm et al. | 229/113 |
| 5,890,648 | A | * | 4/1999 | Cai | 229/120.05 |
| 5,908,152 | A | * | 6/1999 | Tullis | 229/120.16 |
| 6,012,628 | A | * | 1/2000 | Shaikh et al. | 229/103.2 |
| 6,063,416 | A | * | 5/2000 | Teasdale et al. | 426/115 |
| 6,206,277 | B1 | * | 3/2001 | Correll | 229/101 |
| 6,213,389 | B1 | * | 4/2001 | Cai | 229/120.08 |
| 6,568,586 | B1 | * | 5/2003 | VanEsley et al. | 229/120.18 |
| 7,051,919 | B1 | * | 5/2006 | Walsh | 229/103 |
| 7,097,038 | B2 | * | 8/2006 | Kinigakis | 206/541 |
| 7,159,760 | B2 | * | 1/2007 | Pluck et al. | 229/120.09 |
| 7,232,054 | B2 | * | 6/2007 | Yocum | 229/114 |
| 7,293,695 | B2 | * | 11/2007 | Stier | 229/120.14 |
| 2002/0109361 | A1 | | 8/2002 | Parthenis | |
| 2002/0129581 | A1 | | 9/2002 | Correll | |
| 2004/0101605 | A1 | | 5/2004 | Siegel | |
| 2004/0200891 | A1 | * | 10/2004 | Correll | 229/120.05 |

* cited by examiner

BLANK AND METHODS OF CONSTRUCTING A FOOD HOLDER FROM THE BLANK

CROSS REFERENCE TO RELATED APPLICATIONS

This application claims priority to and the benefit of the filing date of U.S. Provisional Application No. 60/786,186 filed on Mar. 27, 2006, the contents of which are hereby incorporated by reference.

BACKGROUND OF THE INVENTION

This invention relates generally to a food holder formed from a sheet of material, and more particularly to food holders and methods for constructing the food holders.

It is well known in the food industry, particularly the fast food industry, to provide a food product to a consumer that is packaged in film, foil, paperwrap, a box, or a container. At least some of these containers are referred to as clam-shell type containers. Such containers provide a convenient method to carry the food product to a table for consumption. It is also convenient to place multiple containers in a bag so a customer is able to carry those containers from the restaurant for consumption elsewhere.

In at least some cases, when the food products are removed from the fast food restaurant, the food products are not consumed in an ideal environment such as seated at a table with napkins, utensils, and both hands available for use. Rather, consumption of the food product may occur while standing, walking, or may even occur within a car. Most food products sold are not designed or assembled to enable eating in such a manner without potentially creating a mess for the consumer. Some food products commonly sold for fast consumption on-the-move are, for example, hamburgers, chicken sandwiches and burritos. They are commonly served on buns or wraps and sometimes include, among other toppings, ketchup, mustard, mayonnaise, tomatoes, and lettuce. All of these toppings can easily fall from between the buns or out of the wraps onto an individual causing increased laundry, ruined clothing, and embarrassment caused by stains on clothing, among other undesirable effects. Also, there are many food products that are just messy by design. Such food products, even when consumed in an ideal environment will pose a potential for excessive drippings and shifting of the food product during consumption.

Accordingly, a device used to hold a food product that facilitates reducing such a food related mess while the food product is being consumed is needed.

BRIEF DESCRIPTION OF THE INVENTION

In one aspect, a food holder formed from a single blank of sheet material is provided. The food holder includes a top tray, a bottom tray, a hinge, and a moveable section. The top tray includes a center panel, a side panel, and an end panel, wherein the panels are interconnected. The bottom tray includes a center panel, a side panel, and an end panel, wherein the panels are interconnected. The hinge connects the top tray to the bottom tray for rotating the top tray from an open position to a closed position wherein a food product is held by the food holder. The movable section is included within the top tray side panel and the bottom tray side panel. The movable section is configured to facilitate movement of the top tray center panel relative to the bottom tray center panel for conforming the food holder to a shape or size of the food product, and to facilitate movement of at least one of the top tray end panel and the bottom tray end panel for discharging the food product from the food holder.

In another aspect, a food holder for retaining a food product is provided. The food holder is formed from a continuous blank of sheet material. The food holder includes a top tray including a center panel, a side panel, and an end panel coupled together along a plurality of fold lines. The food holder further includes a bottom tray including a center panel, a side panel, and an end panel coupled together along a plurality of fold lines. The bottom tray is rotatably coupled to the top tray along a hinge line. The top tray is rotatable relative to the bottom tray from an open position to a closed position. The food holder further includes a moveable section including a portion of at least one of the top tray side panel and the bottom tray side panel. The moveable section facilitates movement of the top tray relative to the bottom tray for retaining the food product.

In a further aspect, a food holder for retaining a food product is provided. The food holder is formed from a continuous blank of sheet material. The food holder includes a top tray including a center panel, a first side panel, an opposing second side panel, a first end panel, and an opposing second end panel coupled together along a plurality of fold lines. The food holder further includes a bottom tray including a center panel, a first side panel, an opposing second side panel, a first end panel, and an opposing second end panel coupled together along a plurality of fold lines. The bottom tray extends from the top tray along a hinge line. Top tray is rotatable relative to the bottom tray from an open position to a closed position. The food holder further includes a moveable section including a portion of at least one of the top tray second side panel, and the bottom tray second side panel. The moveable section facilitates movement of the top tray relative to the bottom tray for retaining the food product.

In a further aspect, a food holder assembly for retaining a product is provided. The food holder assembly includes a food holder formed from a continuous blank of sheet material. The food holder includes a top tray including a center panel, a side panel, and an end panel coupled together along a plurality of fold lines. The food holder further includes a bottom tray including a center panel, a side panel, and an end panel coupled together along a plurality of fold lines. The bottom tray is rotatably coupled to the top tray along a hinge line. The top tray is rotatable relative to the bottom tray from an open position to a closed position. The food holder further includes a moveable section including a portion of at least one of the top tray side panel and the bottom tray side panel. The moveable section facilitates movement of the top tray relative to the bottom tray for retaining the food product. The food holder assembly further includes a tray carton wherein the tray carton is configured to receive at least one of the top tray and the bottom tray.

In another aspect, a method of constructing a food holder for retaining a food product is provided. The food holder is formed from a continuous blank of sheet material including an interior surface and opposing exterior surface. The food holder includes a top tray including a center panel, a side panel, and an end panel coupled together along a plurality of first fold lines. The food holder further includes a bottom tray including a center panel, a side panel, and an end panel coupled together along a plurality of second fold lines. The bottom tray is rotatably coupled to the top tray along a hinge line. The food holder further includes a moveable section including a portion of at least one of the top tray side panel and the bottom tray side panel. The moveable section facilitates movement of the top tray relative to the bottom tray for retaining the food product. The top tray further includes a top tray glue flap including a locking tab defined within the top tray glue flap. The bottom tray further includes a bottom tray glue flap extending from the bottom tray end panel along a fold line. The bottom tray glue flap includes a hook portion that engages the locking tab to maintain the food holder in the closed position. The method includes providing the blank of sheet material, folding the top tray center panel, side panel, and end panel towards the interior surface of the food holder along the plurality of first fold lines, folding the bottom tray center panel, side panel, and end panel towards the interior surface of the food holder along the plurality of second fold lines, rotating the top tray relative to the bottom tray along the hinge line from an open position to a closed position to form a cavity, and positioning the food product within the cavity such that the food product is retained within the food holder.

In a further aspect, a blank for forming a food holder for retaining a food product is provided. The blank includes a top tray including a center panel, a side panel, and an end panel coupled together along a plurality of fold lines. The blank further includes a bottom tray including a center panel, a side panel, and an end panel coupled together along a plurality of fold lines. The bottom tray is rotatably coupled to the top tray along a hinge line. The top tray is rotatable relative to the bottom tray from an open position to a closed position. The blank further includes a moveable section including a portion of at least one of the top tray side panel and the bottom tray side panel. The moveable section facilitates movement of the top tray relative to the bottom tray for retaining the food product.

DETAILED DESCRIPTION OF THE INVENTION

The present invention provides a stackable, collapsible container for use as a food holder, and a method for constructing the food holder. The food holder is constructed using a machine from a blank of sheet material. In one embodiment, the food holder is fabricated from a paperboard material. The food holder, however, may be fabricated using any suitable material, and therefore is not limited to a specific type of material. In alternative embodiments, the food holder is fabricated using cardboard, plastic and/or any suitable material known to those skilled in the art and guided by the teachings herein provided.

In one embodiment, the food holder includes a marking thereon including, without limitation, indicia that communicates the product, a manufacturer of the product and/or seller of the product. For example, the marking may include printed text that indicates a product's name and briefly describes the product, logos and/or trademarks that indicate a manufacturer and/or seller of the product, and/or designs and/or ornamentation that attract attention.

Figure 1:
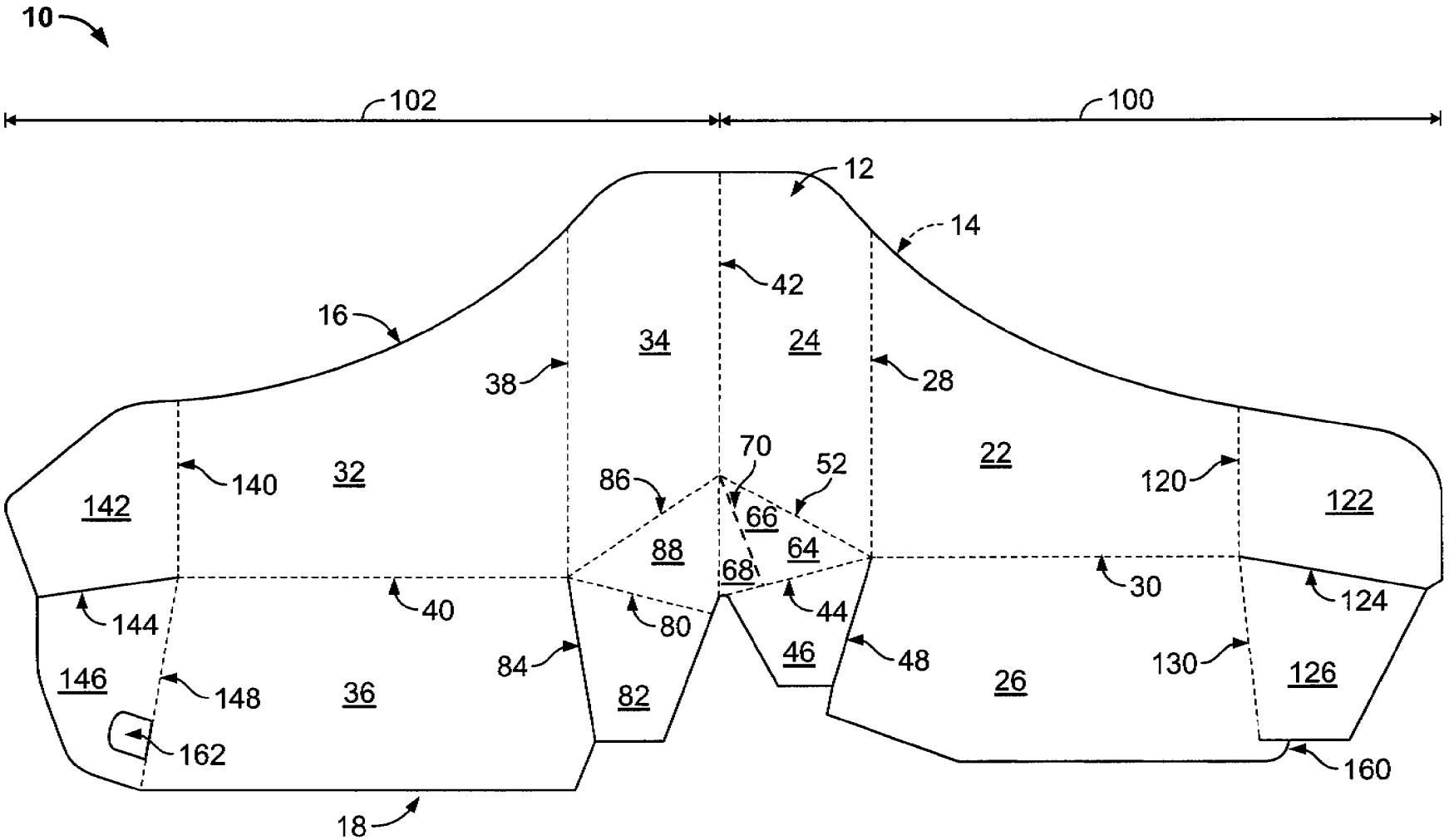
FIG. 1 a top plan view of a blank of sheet material for constructing a food holder according to one embodiment of this invention.
Figure 2:
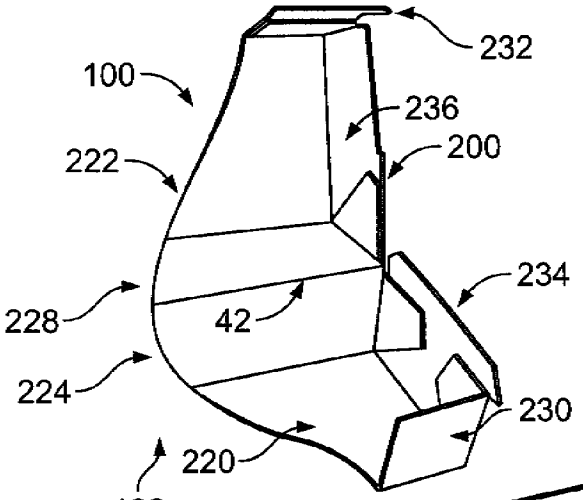
FIG. 2 is a perspective view of a food holder constructed from the blank shown in FIG. 1.

Referring to the drawings, and more specifically to FIGS. 1 and 2, a food holder may have any suitable size, shape and/or configuration. FIGS. 1 and 2 illustrate the construction or formation of a first embodiment of a food holder. Specifically, FIG. 1 is a top plan view of one embodiment of a blank of sheet material 10. FIG. 2 is a perspective view of a food holder 200 constructed from blank 10 of FIG. 1.

Referring to FIG. 1, blank 10 has an interior surface 12 and an opposing exterior surface 14. Further, blank 10 defines a leading edge 16 and an opposing trailing edge 18. In the exemplary embodiment, blank 10 includes a top tray or first center panel 22, a top tray or first side panel 24, and a top tray or first end panel 26. First side panel 24 and first end panel 26 are coupled to top tray center panel 22 by preformed fold lines 28 and 30, respectively. Specifically, first side panel 24 extends from top tray center panel 22 along respective fold line 28 and first end panel 26 extends from top tray center panel 22 along respective fold line 30.

Blank 10 also includes a bottom tray or second center panel 32, a bottom tray or second side panel 34, and a bottom tray or second end panel 36. Second side panel 34 and end panel 36 are coupled to bottom tray center panel 32 by preformed fold lines 38 and 40, respectively. Specifically, second side panel 34 extends from bottom tray center panel 32 along respective fold line 38 and second end panel 36 extends from bottom tray center panel 32 along respective fold line 40. Second side panel 34 is hingedly coupled to first side panel 24 by a hinge line 42. Hinge line 42 is substantially parallel to fold lines 28 and 38, and runs from leading edge 16 toward opposing trailing edge 18. It is apparent to those skilled in the art and guided by the teachings herein provided that fold lines 28, 30, 38, and/or 40, as well as other fold lines described herein, may include any suitable line of weakening known to those skilled in the art and guided by the teachings herein provided.

First side panel 24 is defined by a fold line 44 which forms one edge of a glue flap 46. Glue flap 46 is further defined by a cut line 48 which separates glue flap 46 from end panel 26. Fold lines 52 and 44, along with hinge line 42, create a triangular panel 64 within first side panel 24. Triangular panel 64 is further divided into two triangular panels 66 and 68 by a fold line 70. Two triangular panels 66 and 68 may be referred to as a first triangular panel 66 and a third triangular panel 68. Fold line 70 extends from about the corner formed by the intersection of fold line 52 and hinge line 42, and extends to fold line 44.

Second side panel 34 is defined by a fold line 80 which forms one edge of a glue flap 82. Glue flap 82 is further defined by a cut line 84 which separates glue flap 82 from end panel 36. Second side panel 34 further includes a fold line 86. Fold lines 86 and 80, along with hinge line 42, create a triangular panel 88 within second side panel 34. Triangular panel 88 may be referred to as second triangular panel 88. Triangular panels 64 and 88, along with fold lines 44, 52, 80 and 86, define a moveable section of food holder 200. As explained below in more detail, when food holder 200 is formed, this moveable section, which includes fold line 70, enables a user using food holder 200 to more securely hold a food product and facilitates discharge of the food product from food holder 200.

As shown in FIG. 1, top portion 100 and bottom portion 102 are connected along hinge line 42. More specifically, first side panel 24 and second side panel 34 are hingedly connected at hinge line 42.

Top tray center panel 22 includes a fold line 120, opposed to and substantially parallel to fold line 28 that defines an edge of a top flap 122. Top flap 122 is further defined by a fold line 124, which separates top flap 122 from a glue flap 126. An edge of end panel 26 is defined by a cut line 130. Cut line 130, along with fold line 124, define the edges of glue flap 126. Similarly, bottom tray center panel 32 includes a fold line 140, opposed to and substantially parallel to fold line 38 that defines an edge of a glue flap 142. Glue flap 142 is further defined by a cut line 144, which separates glue flap 142 from a bottom flap 146. An edge of end panel 36 is defined by a fold line 148. Fold line 148, along with cut line 144, define the edges of bottom flap 146.

As shown in FIG. 1, a locking tab 160 is formed on the trailing edge 18 of end panel 26 by cut line 130.

Referring further to FIG. 1, a cutout portion 162 is defined along a periphery of bottom flap 146, with one edge of cutout portion 162 in communication with end panel 36 and the other edges of cutout portion 162 located within bottom flap 146. In an alternative embodiment, a relief area could be used instead of cutout portion 162. More specifically, the relief area could include a female relief configured to receive a male locking tab or other type of overlapping or intersecting surface such that the top tray can be locked in a closed position to the bottom tray.

When food holder 200 is formed, and top portion 100 is rotated about hinge line 42, cutout portion 162 is configured to receive locking tab 160. Once locking tab 160 is inserted within cutout portion 162, top portion 100 is coupled or releasably locked to bottom portion 102 and food holder 200 will remain in a closed configuration such that food holder 200 is extended around the food product without being held around the food product by the user. This allows the user to transfer the food product within food holder 200 between hands, or to another individual, without food holder 200 opening. It also allows the user to set the food product and food holder 200 on a surface between bites and not have to re-position food holder 200 around the food product, while still allowing the user to reposition the food product within food holder 200 if the user so desires. Cutout portion 162 in combination with locking tab 160 is one example of a mechanism to keep food holder 200 around a food product. Any other mechanism known to keep a box or container closed including, but not limited to, a hook and tab, an interlocking overlapped flap, an adhesive, or a slit and finger, may also be used.

In the exemplary embodiment, food holder 200 is constructed from blank 10 for holding food to ease consumption. Food holder 200 is formed from blank 10 by folding blank 10 about the fold lines. In one embodiment, an adhesive material is applied to portions of blank 10 to secure selected portions of food holder 200 together. In a particular embodiment, food holder 200 is constructed using a machine. Food holder 200 includes a bottom center wall 220, a top center wall 222 and opposing bottom center wall 220, a bottom side wall 224 hingedly connected to a top side wall 228, a bottom flap wall 230 and a top flap wall 232 opposing bottom side wall 224 and top side wall 228 respectively, a bottom end wall 234 connecting bottom side wall 224 to bottom flap wall 230, and a top end wall 236 connecting top side wall 228 to top flap wall 232. The walls can also be referred to as panels.

Figure 3:
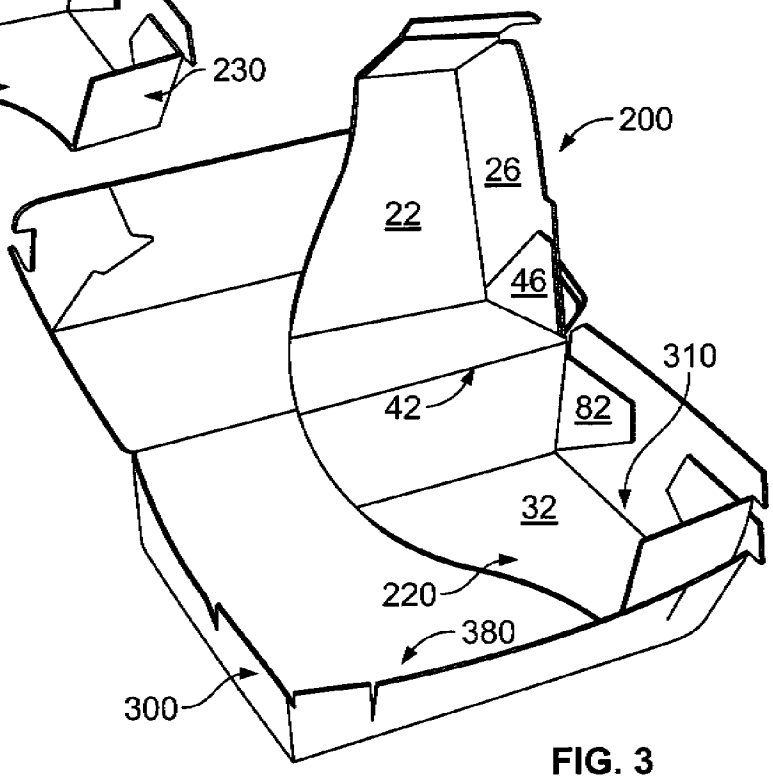
FIG. 3 is a perspective view of the food holder shown in FIG. 2 placed within an exemplary clam-shell container.
Figure 4:
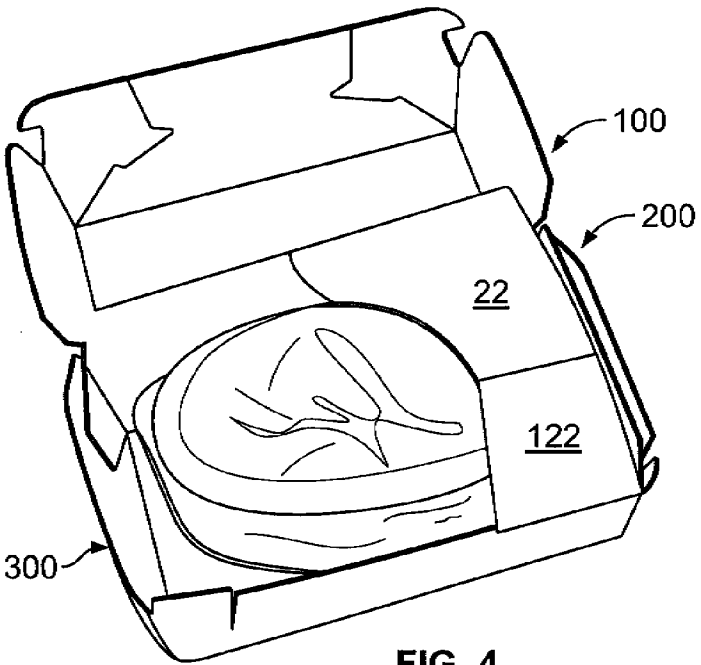
FIG. 4 is another perspective view of the food holder shown in FIG. 2 placed within an exemplary clam-shell container with a food product contained therein.
Figure 5:
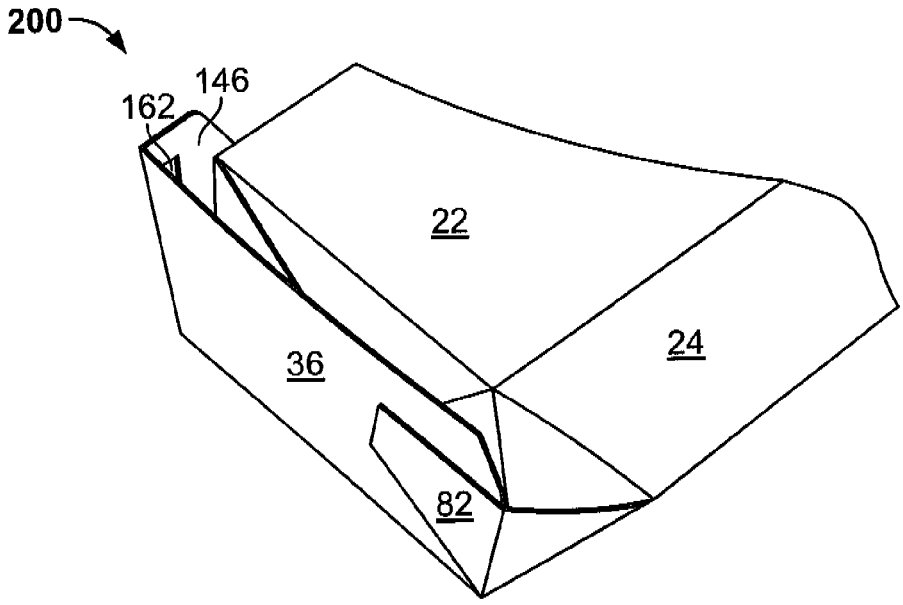
FIG. 5 is another perspective view of the food holder shown in FIG. 2.

FIG. 3 is a perspective view of food holder 200 placed within an exemplary clam-shell container 300. Food holder 200 and container 300 form a food holder assembly. Constructed food holder 200 defines a semi-enclosed area or a cavity 310 within which a food product can be placed, as is shown in FIG. 4. FIG. 4 is another perspective view of food holder 200 placed within an exemplary clam-shell container 300 with a food product contained therein. FIG. 5 is another perspective view of the food holder shown in FIG. 2.

Referring back to FIGS. 1 and 2, to create formed food holder 200, glue flap 126 is rotated about fold line 124, flap 122 is rotated about fold line 120, glue flap 46 is rotated about fold line 44, and top tray center panel 22 is rotated about fold line 28. Once these folds are complete, when end panel 26 is rotated about fold line 30, the interior surface of end panel 26 is placed in contact with the exterior surfaces of glue flaps 126 and 46. In one embodiment, end panel 26 is coupled to glue flaps 126 and 46 using a suitable coupler, such as an adhesive material strip or tape (not shown) applied to the exterior surfaces of glue flaps 126 and 46. In another embodiment, end panel 26 is coupled to glue flaps 126 and 46 using a suitable coupler, such as an adhesive material strip or tape (not shown) applied to the interior surfaces of end panel 26 that are in contact with glue flaps 126 and 46. This forms top portion 100 of food holder 200. Top portion 100 of food holder 200 includes top center wall 222, top side wall 228, top flap wall 232 which is opposed to top side wall 228, and top end wall 236 which is connected to top center wall 222 and extends from top side wall 228 to top flap wall 232.

Bottom portion 102 is formed in a similar manner to top portion 100. Referring to FIGS. 1 and 2, glue flap 142 is rotated about fold line 140, flap 146 is rotated about fold line 148, glue flap 82 is rotated about fold line 80 and bottom tray center panel 32 is rotated about fold line 38. Once these folds are complete, when end panel 36 is rotated about fold line 40, the interior surface 12 of flap 146 is brought into contact with the exterior surface 14 of glue flap 142. Also, the exterior surface 14 of glue flap 82 is brought into contact with the interior surface 12 of end panel 36. In one embodiment, end panel 36 is coupled to glue flaps 82 and 142 using a suitable coupler, such as an adhesive material strip or tape (not shown) applied to the exterior surface 14 of glue flaps 82 and 142. In another embodiment, end panel 36 is coupled to glue flaps 82 and 142 using a suitable coupler, such as an adhesive material strip or tape (not shown) applied to the interior surfaces 12 of end panel 36 and flap 146 that are in contact with the exterior surfaces 14 of glue flaps 82 and 142. This forms bottom portion 102 of food holder 200. Bottom portion 102 of food holder 200 includes bottom center wall 220, bottom side wall 224, bottom flap wall 230 which is opposed to bottom side wall 224, and bottom end wall 234 which is connected to bottom center wall 220 and extends from bottom side wall 224 to bottom flap wall 230.

Top portion 100 is rotatably attached to bottom portion 102 along hinge line 42 which is located between top side wall 228 and bottom side wall 224. FIG. 2 shows exemplary food holder 200 in an open configuration, ready to be placed within a container. In an open configuration, top portion 100 is rotated away from bottom portion 102 about hinge line 42. As side walls 224 and 228 rotate about hinge line 42, they form a V-shaped channel. When food holder 200 is in an open configuration, this V-shaped channel opens towards the exterior of food holder 200. FIG. 3 is a perspective view of food holder 200 placed within an exemplary clam-shell container 300. Hinge line 42 within the V-shaped channel is aligned with the hinge of the exemplary clam-shell container 300, and bottom center wall 220 of food holder 200 is placed in communication with a bottom wall 380 of the exemplary clam-shell container 300.

As exemplary clam-shell container 300 is rotated towards a closed configuration, food holder 200 is also rotated in unison into a closed configuration due to the force of container 300 being applied to food holder 200. Cutout portion 162, in combination with locking tab 160, releasably locks food holder 200 around the food product as container 300 is closed. Food holder 200 can also be rotated into a releasably locked state without container 300 being closed around it. This would enable food holder 200 to be placed in a closed position while container 300 is in an open position, allowing more items to be placed within container 300. Side walls 224 and 228 and hinge line 42 of food holder 200 are in communication with the side panels and the hinge of container 300 when food holder 200 is placed within container 300 such that hinge line 42 of food holder 200 is substantially parallel with the hinge of container 300. Accordingly, when container 300 is closed, food holder 200 is closed.

When the food product is contained within food holder 200, a user is then able to consume the food product and operate food holder 200. In operation, the user begins to consume the food product projecting outside food holder 200. As the food product that projects outside food holder 200 is consumed, the user squeezes top center wall 222 towards bottom center wall 220, the moveable section (shown in FIG. 1) allows the distance between top center wall 222 and bottom center wall 220 to decrease, which in turn allows food holder 200 to conform to the shape and size of the food product. Fold line 70 (shown in FIG. 1) enables food holder 200 to conform to the shape and size of the food product even more closely. When top center wall 222 is squeezed towards bottom center wall 220, hinge line 42 extends outward from cavity 310. Moreover, when top center wall 222 is moved towards bottom center wall 220, fold line 70 allows triangular panel 66 to translate towards the interior of food holder 200, and more specifically, allows triangular panel 68 to rotate about hinge line 42 until fold line 70 and interior surface 12 of triangular panel 68 comes into contact in a face-to-face relationship with the interior surface of triangular panel 88, and fold line 70 and triangular panel 68 are on the opposite side of hinge line 42 as previously located. Furthermore, when triangular panel 68 is rotated about hinge line 42, exterior surface 14 of triangular panel 68 comes into contact in a face-to-face relationship with exterior surface 14 of triangular panel 66. In addition to allowing food holder 200 to better conform to the food product, the translation of panel 66 toward panel 88 via panel 68 also facilitates the discharge of the food product out of food holder 200. Triangular panels 66, 68, and 88 may be formed in any shape so long as the shape allows food holder 200 to better conform to the food product and facilitates the discharge of the food product out of food holder 200.

FIG. 4 shows top portion 100 of food holder 200, rotated about hinge line 42, into a closed configuration surrounding the exemplary food product. Cutout portion 162 (not shown) has received locking tab 160 (not shown), holding top portion 100 in position such that food holder 200 surrounds the food product. Similarly, FIG. 5 depicts food holder 200 in the closed configuration wherein cutout portion 162 is engaged with locking tab 160.

Figure 6:
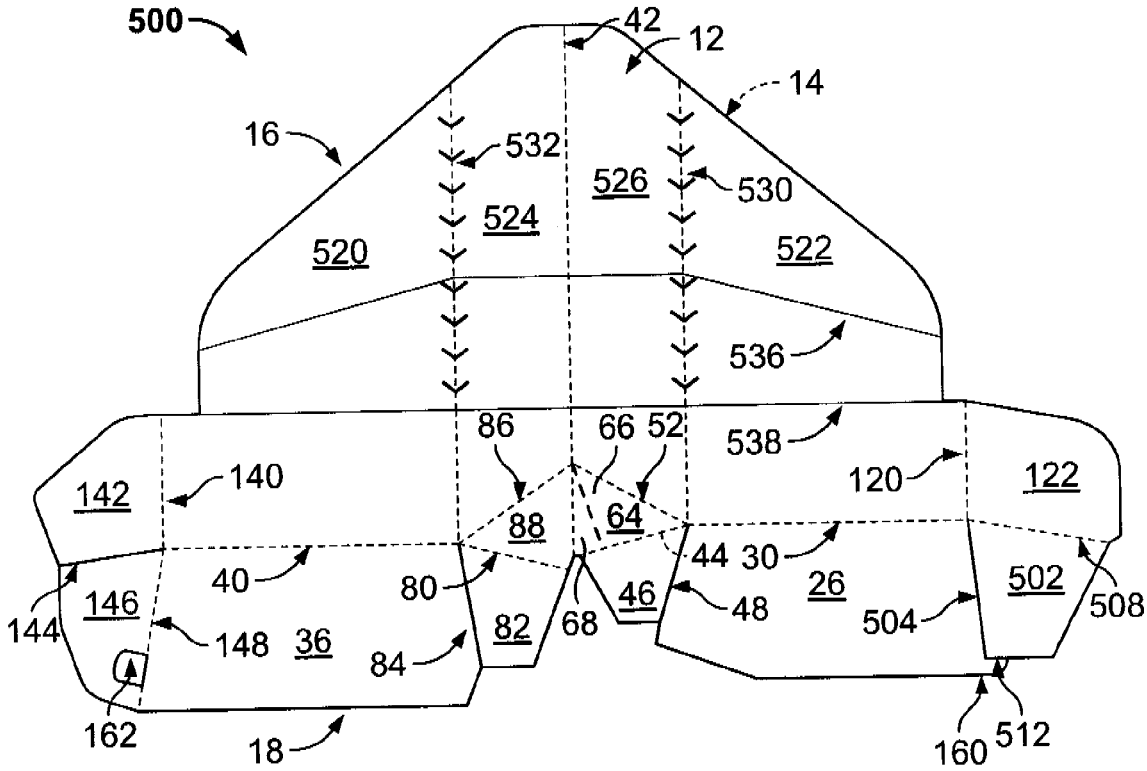
FIG. 6 is a top plan view of a blank of sheet material for constructing a food holder according to a first alternative embodiment of this invention.

FIG. 6 illustrates a top plan view of a blank of sheet material for constructing a food holder according to a first alternative embodiment of this invention. Specifically, FIG. 6 is a top plan view of a first alternative embodiment of a blank of sheet material 500. Blank 500 is similar to blank 10 from FIG. 1, and like components are identified with like reference numerals. In contrast to the exemplary embodiment, bottom tray center panel 520, top tray center panel 522, and side panels 524 and 526 are longer than respective panels of blank 10. More specifically, the distance between leading edge 16 and trailing edge 18 is greater in the first alternative embodiment. The longer length of bottom tray center panel 520, top tray center panel 522, and side panels 524 and 526 will allow the food holder to support a longer food product. Blank 500 also contains perforated tear lines 530 and 532 in place of fold lines 28 and 38 respectively, and adds tear lines 536 and 538 which extend from leading edge 16 of bottom tray center panel 520 to leading edge 16 of top tray center panel 522. These tear lines allow the user to peel down the side panels 524, 526 and peel away the top and bottom tray center panels 520, 522 to gain access to the food product within the food holder. Also in contrast to the exemplary embodiment, bottom tray center panel 520 and top tray center panel 522 are shaped differently than bottom tray center panel 32 and top tray center panel 22. On blank 10, the transitions from leading edge 16 of bottom tray center panel 32 to glue flap 142, and from top tray center panel 22 to flap 122, are continuous arcs. In contrast to FIG. 1, leading edge 16 of bottom tray center panel 520 and top tray center panel 522 of FIG. 6 contain cuts at approximately right angles at points located along tear line 538 and between fold line 140 and tear line 532 of bottom tray center panel 520, and along tear line 538 and between fold line 120 and tear line 530 of top tray center panel 522.

Moreover, in contrast to the exemplary embodiment, a glue flap 502 is formed in a different manner than glue flap 126. In FIG. 1, glue flap 126 is defined by fold line 124, separating it from flap 122, and cut line 48, separating it form end panel 26. In FIG. 6, glue flap 502 is defined by a cut line 504, which separates it from end panel 26, and a fold line 508, which separates it from flap 122. This also means that locking tab 160 is formed by a cut line 512 extending from trailing edge 18 to fold line 504.

Figure 7:
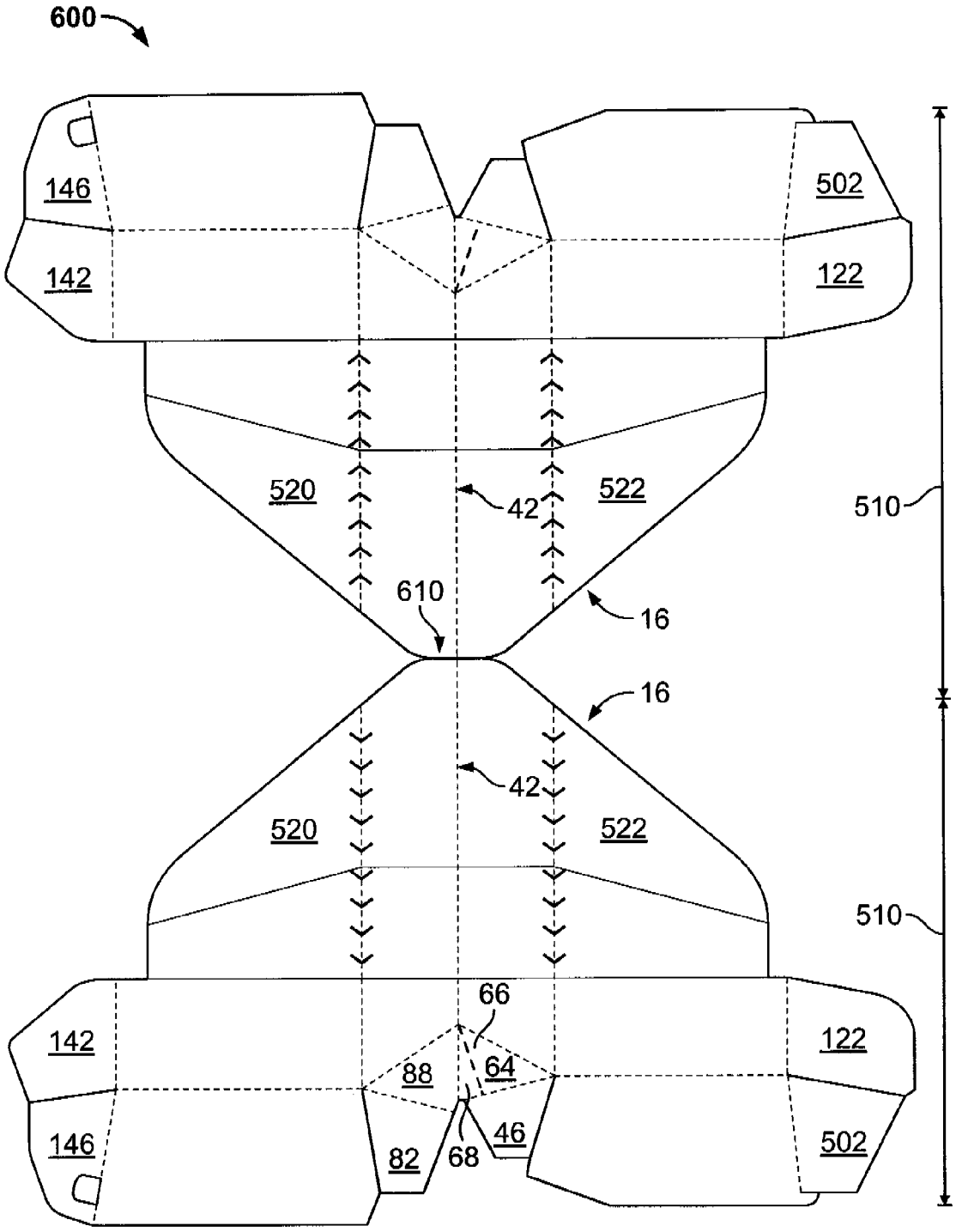
FIG. 7 is a top plan view of a blank of sheet material for constructing a tandem unit of two food holders according to the first alternative embodiment shown in FIG. 6.

FIG. 7 illustrates a top plan view of a blank of sheet material for constructing a tandem unit of two food holders according to the first alternative embodiment shown in FIG. 6. Specifically, FIG. 7 is a top plan view of a blank of sheet material 600 for constructing a tandem unit of two food holders 550 according to the first alternative embodiment as shown in FIG. 6. Blank 600 is made up of two individual units 510, each being a food holder according to the first alternative embodiment and like components are identified with like reference numerals. The two individual food holders 550 are connected by a tear line 610 along their leading edges 16. The embodiment of FIG. 7, and similar tandem embodiments, provide twice the throughput in production, allow for easier handling and stacking, and may also facilitate longer food products that are intended to have a food holder at each end, or facilitate placing two separate food products within the same larger food container with a food holder provided for each food product within the larger food container.

Figure 8:
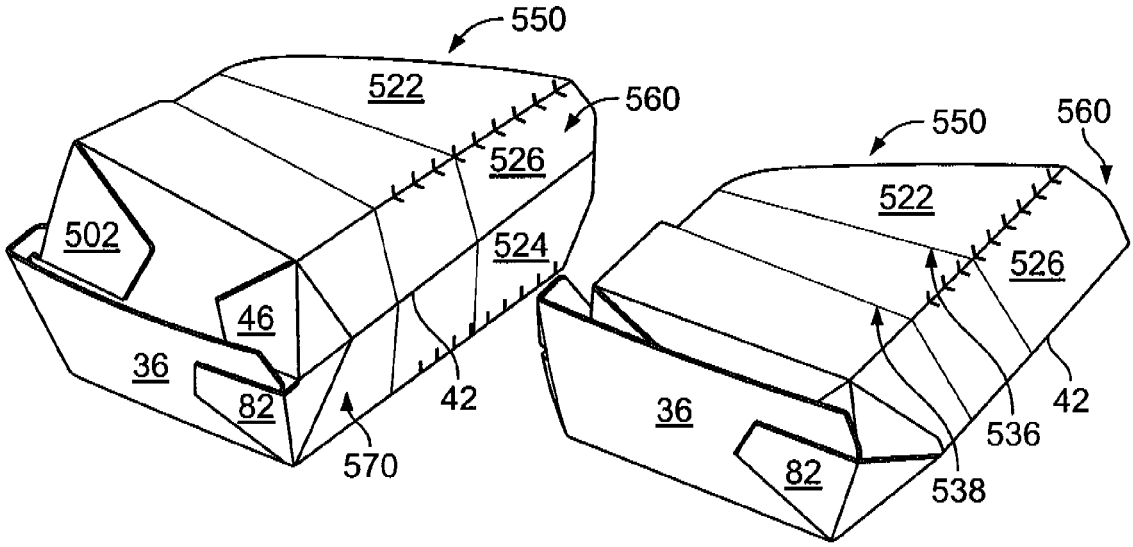
FIG. 8 is a perspective view of two food holders constructed from the blank shown in FIG. 7.

FIG. 8 illustrates a perspective view of two food holders constructed from the blank shown in FIG. 7. Referring back to FIGS. 6 and 7, each individual unit 510 is formed into a food holder 550. Food holder 550 is formed in a similar manner to food holder 200. However, a few differences are present in assembly of food holder 550. Specifically, glue flap 502 is rotated about fold line 508, flap 122 is rotated about line 120, glue flap 46 is rotated about fold line 44, and top tray center panel 522 is rotated about tear line 530. Once these folds are complete, end panel 26 is rotated about fold line 30, and the interior surface of end panel 26 is placed in contact with the exterior surfaces of glue flaps 502 and 46. In another embodiment, end panel 26 is rotated about fold line 30, and the exterior surface of end panel 26 is placed in contact with the interior surfaces of glue flaps 502 and 26. In one embodiment, end panel 26 is coupled to glue flaps 502 and 46 using a suitable coupler, such as an adhesive material strip or tape (not shown) applied to the exterior surfaces of glue flaps 502 and 46. In another embodiment, end panel 26 is coupled to glue flaps 502 and 46 using a suitable coupler, such as an adhesive material strip or tape (not shown) applied to the interior surfaces of end panel 26 that are in contact with glue flaps 502 and 46. This forms a top portion 560 of food holder 550.

A bottom portion 570 is formed in a somewhat similar manner to top portion 560. Referring to FIGS. 6 and 7, glue flap 142 is rotated about fold line 140, flap 146 is rotated about fold line 148, glue flap 82 is rotated about fold line 80 and bottom tray center panel 520 is rotated about tear line 532. Once these folds are complete, end panel 36 is rotated about fold line 40 and the interior surface 12 of flap 146 is brought into contact with the exterior surface 14 of glue flap 142. Also, the exterior surface 14 of glue flap 82 is brought into contact with the interior surface 12 of end panel 36. In one embodiment, end panel 36 is coupled to glue flaps 82 and 142 using a suitable coupler, such as an adhesive material strip or tape (not shown) applied to the exterior surface 14 of glue flaps 82 and 142. In another embodiment, end panel 36 is coupled to glue flaps 82 and 142 using a suitable coupler, such as an adhesive material strip or tape (not shown) applied to the interior surfaces 12 of end panel 36 and flap 146 that are in contact with the exterior surfaces 14 of glue flaps 82 and 142. This forms bottom portion 570 of food holder 550.

Top portion 560 is rotatably attached to bottom portion 570 along hinge line 42 which is located between side panel 524 and side panel 526. When food holder 550 is formed, and top portion 560 is rotated about hinge line 42, cutout portion 162 is configured to receive locking tab 160. Once locking tab 160 is inserted within cutout portion 162, top portion 560 is coupled or releasably locked to bottom portion 570 and food holder 550 will remain in a closed configuration.

Figure 9:
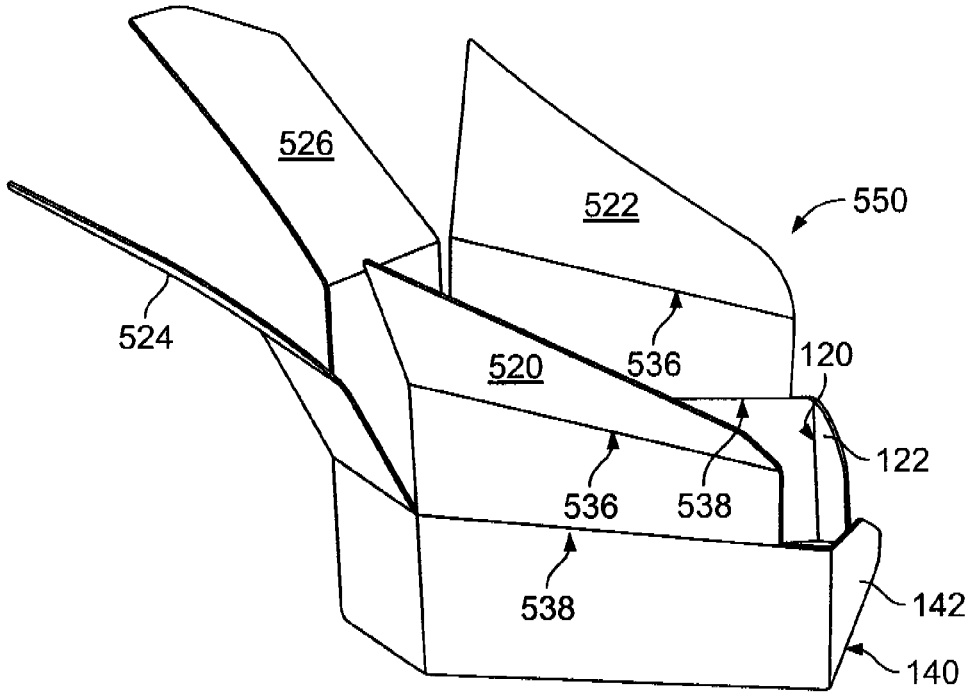
FIG. 9 is a perspective view of a food holder constructed from the blank shown in FIG. 6.

FIG. 9 is a perspective view of food holder 550. Specifically, locking tab 160 is releasably coupled to cutout portion 162, side panels 524 and 526 have been separated along hinge line 42, and center panels 520 and 522 have been separated from side panels 524 and 526 along tear lines 532 and 530, respectively. Separating panels 520, 522, 524, and 526 allows a user to access the contents of food holder 550.

Figure 10:
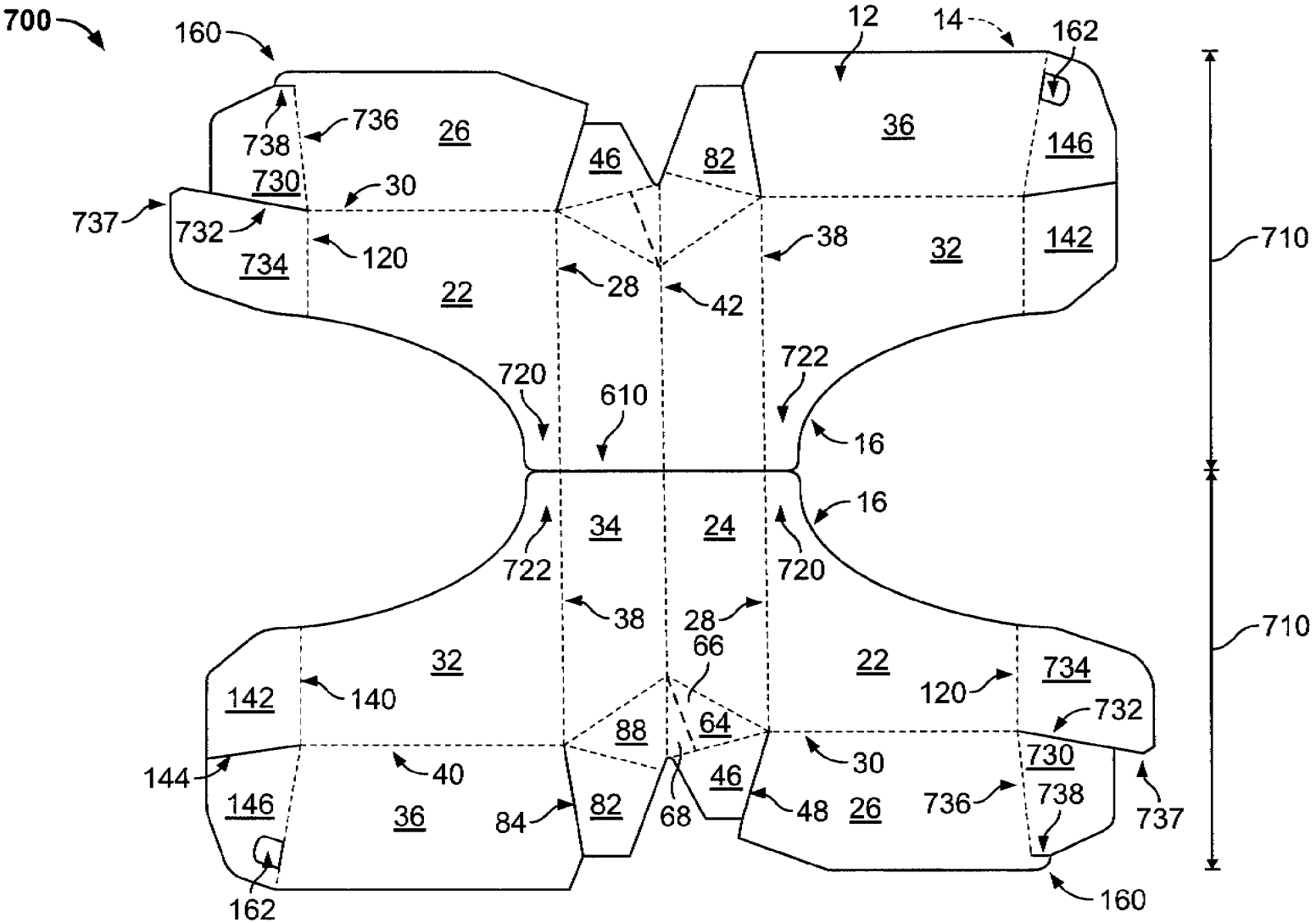
FIG. 10 is a top plan view of a blank of sheet material for constructing a tandem unit of two food holders according to a second alternative embodiment of this invention.

FIG. 10 illustrates a top plan view of a blank of sheet material for constructing a tandem unit of two food holders according to a second alternative embodiment of this invention. Specifically, FIG. 10 is a top plan view of a blank of sheet material 700 for constructing a tandem unit of two food holders 750 according to a second alternative embodiment of this invention. Blank 700 is similar to blank 600 of FIG. 7, in that they both are tandem configurations of two individual units connected at tear line 610 located on each unit's leading edge 16. But in contrast to the manner in which individual units 510 are aligned with respect to each other in FIG. 7, in FIG. 10 the individual units 710 are essentially copies of each other where one individual unit 710 has been rotated 180 degrees about an axis running through tear line 610 and then rotated again 180 degrees about an axis running through hinge line 42.

Referring further to FIG. 10, the individual units 710 are each similar to blank 10 from FIG. 1, and like components are identified with like reference numerals. In contrast to blank 10, the individual units 710 of FIG. 10 each include two return flanges 720 and 722. These return flanges 720 and 722 are formed within bottom tray center panel 32 and top tray center panel 22 on one side by leading edge 16 and on the other side by fold lines 38 and 28. Return flanges 720 and 722 provide added rigidity when manufacturing, forming, and handling, and also offer additional support for specific food products.

Also in contrast to the exemplary embodiment, a glue flap 730 is formed in a similar manner to glue flap 126. In FIG. 1, glue flap 126 is defined by fold line 124, separating it from flap 122, and cut line 48, separating it from end panel 26. In FIG. 10, glue flap 730 is defined by a cut line 732, which separates it from a flap 734, and a fold line 736, which separates it from end panel 26. This also means that locking tab 160 is formed by cut line 738 extending from trailing edge 18 to fold line 736. Furthermore, glue flap 730 includes a protrusion 737.

Figure 11:
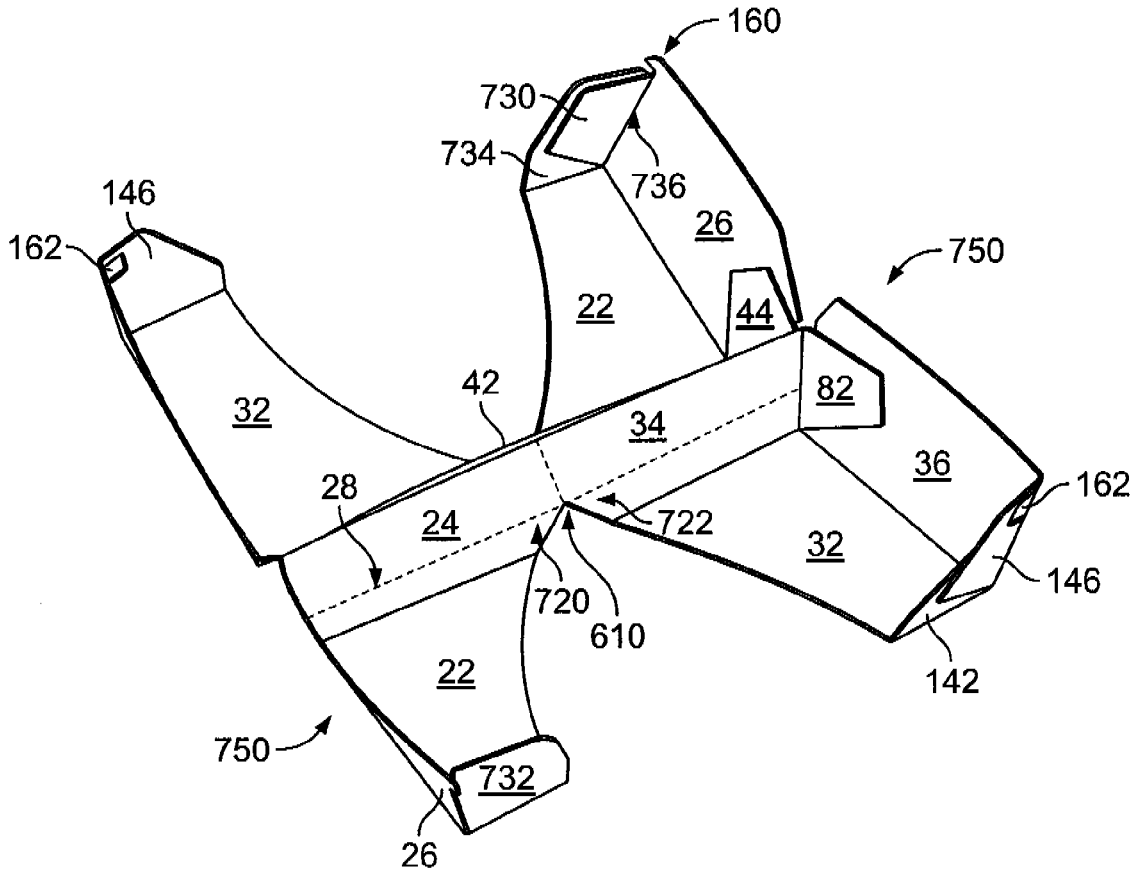
FIG. 11 is a perspective view of a tandem unit of two food holders constructed from the blank shown in FIG. 10.
Figure 12:
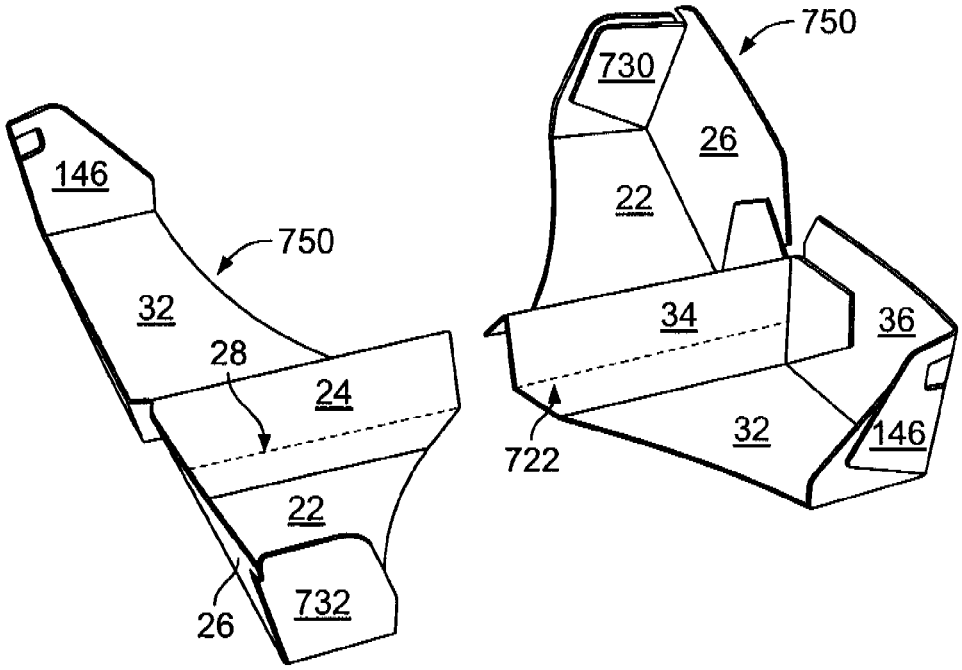
FIG. 12 is a perspective view of two food holders constructed from the blank shown in FIG. 10.
Figure 13:
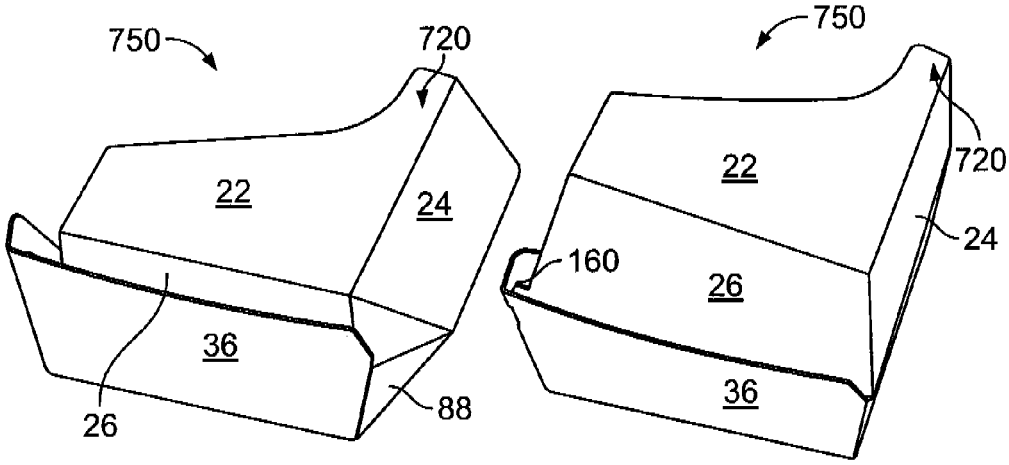
FIG. 13 is a perspective view of the two food holders shown in FIG. 12.

FIG. 10 is a top plan view of blank 700 for constructing a tandem unit of two food holders 750 according to a second alternative embodiment of this invention. FIGS. 11 and 12 are perspective views of food holders 750 constructed from blank 700 in an open configuration. FIG. 13 is a perspective view of food holders 750 constructed from blank 700 in a closed configuration.

Each individual unit 710 is formed into a food holder 750. Food holder 750 is formed in a similar manner to food holder 200. Specifically, to assembly food holder 750, end panel 26 is rotated about fold line 30, flap 734 is rotated about fold line 120, glue flap 730 is rotated about fold line 736, and glue flap 730 is coupled to flap 734. In one embodiment, end panel 26 is coupled to glue flap 46 and flap 734 is coupled to glue flap 730, using a suitable coupler, such as an adhesive material strip or tape (not shown) applied to the exterior surfaces 14 of glue flaps 46 and 730. In another embodiment, end panel 26 is coupled to glue flap 46 and flap 734 is coupled to glue flap 730, using a suitable coupler, such as an adhesive material strip or tape (not shown) applied to the interior surfaces 12 of end panel 26 and flap 734 that will be in contact with glue flaps 46 and 730.

Figure 14:
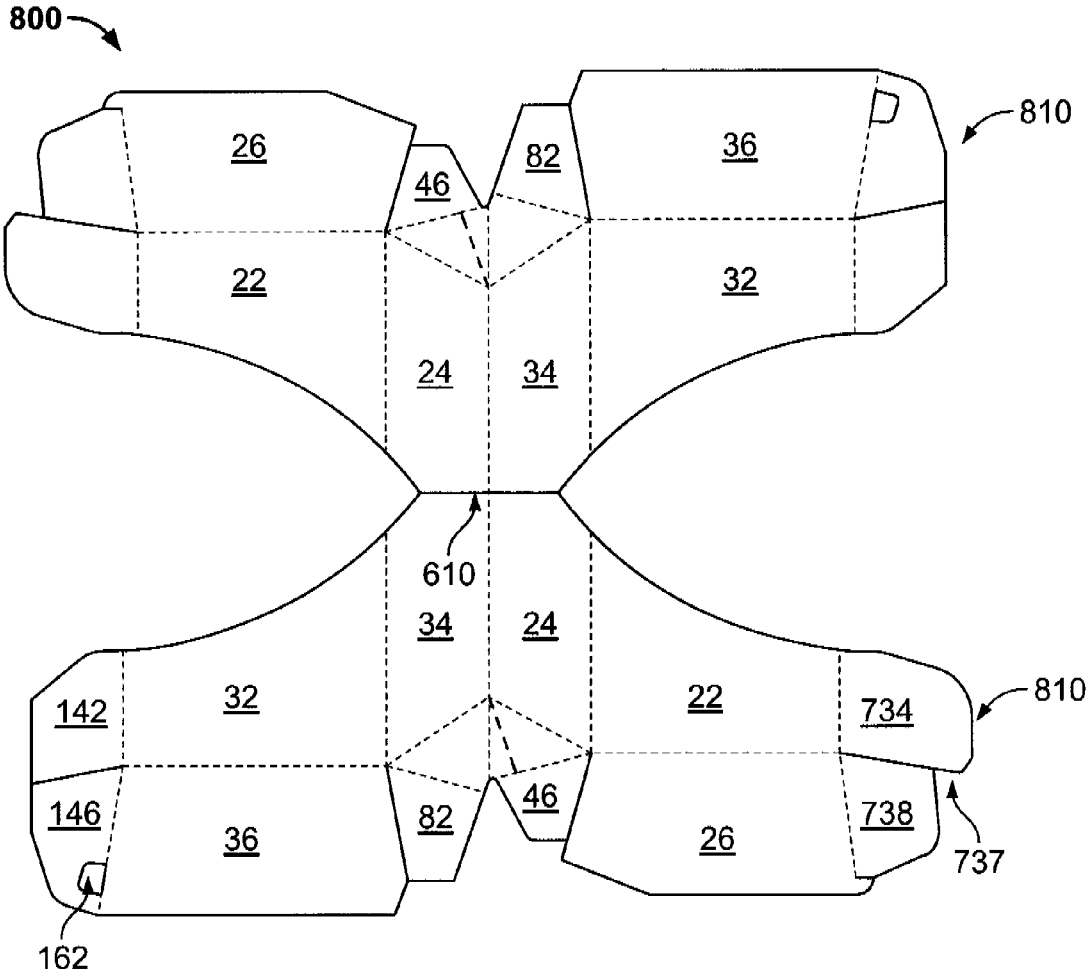
FIG. 14 is a top plan view of a blank of sheet material for constructing a tandem unit of two food holders according to a third alternative embodiment of this invention.
Figure 15:
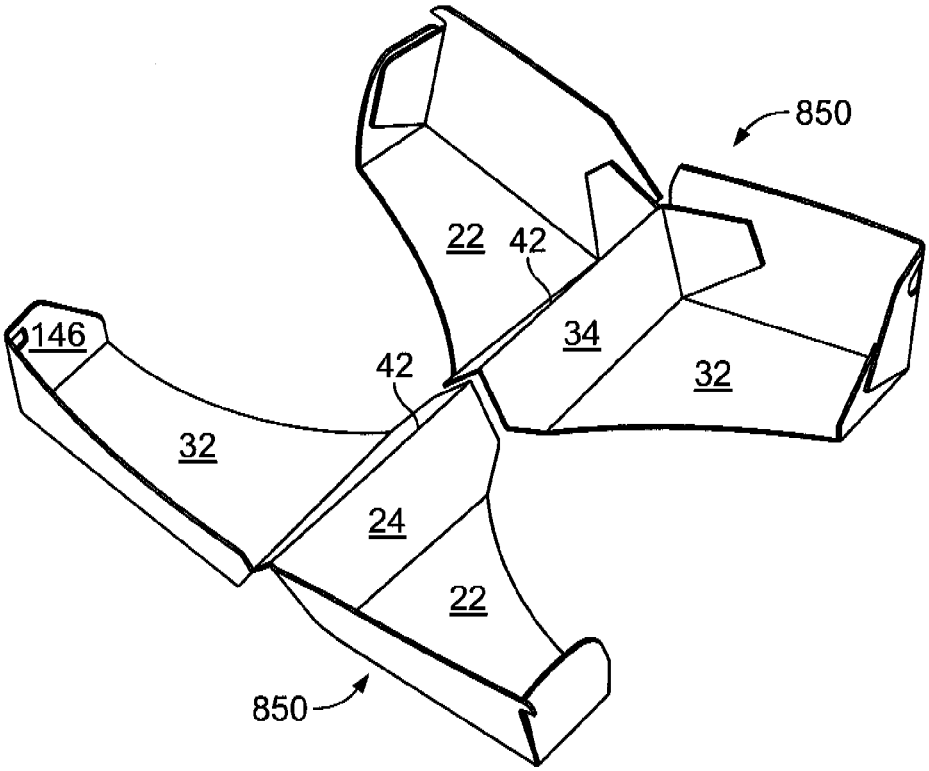
FIG. 15 is a perspective view of two food holders constructed from the blank shown in FIG. 14.
Figure 16:
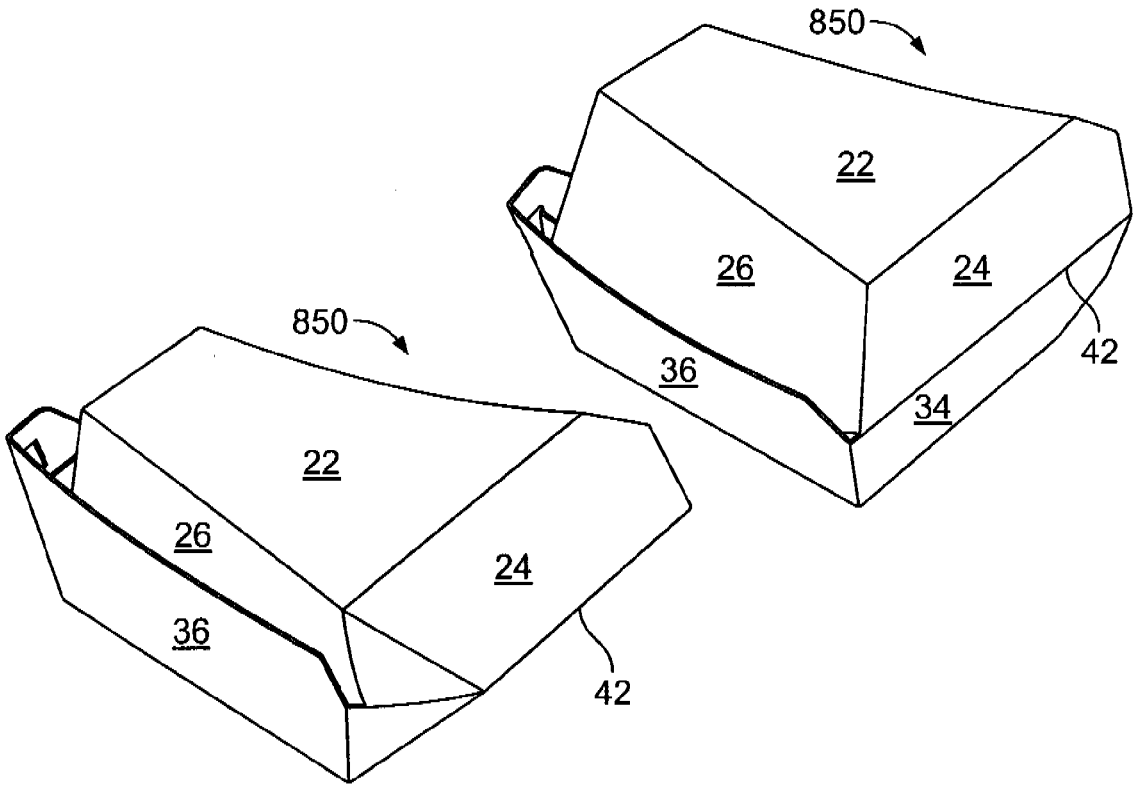
FIG. 16 is another perspective view of the two food holders shown in FIG. 15.

FIG. 14 illustrates a top plan view of a blank of sheet material for constructing a tandem unit of two food holders according to a third alternative embodiment of this invention. Specifically, FIG. 14 is a top plan view of blank of sheet material 800 for constructing a tandem unit of two food holders 850 according to a third alternative embodiment of this invention. FIG. 15 is a perspective view of food holders 850 constructed from blank 800 shown in an assembled, open configuration. FIG. 16 is another perspective view of food holders 850 constructed from blank 800 shown in an assembled, closed configuration.

Blank 800 is similar to blank 700 of FIG. 10, in that they both are tandem configurations of two individual units. Individual units 810 are similar to individual units 710 and like components are identified with like reference numerals. Individual units 810 of FIG. 14 are aligned with respect to each other in the same manner as the individual units 710 of FIG. 10. In contrast to individual units 710 of FIG. 10, individual units 810 do not include return flanges 720 and 722.

The two individual units 810 are connected by a tear line 610 along their leading edges 16, and each individual unit 810 is formed into a food holder 850. Food holder 850 is formed in a similar manner to food holder 750.

Figure 17:
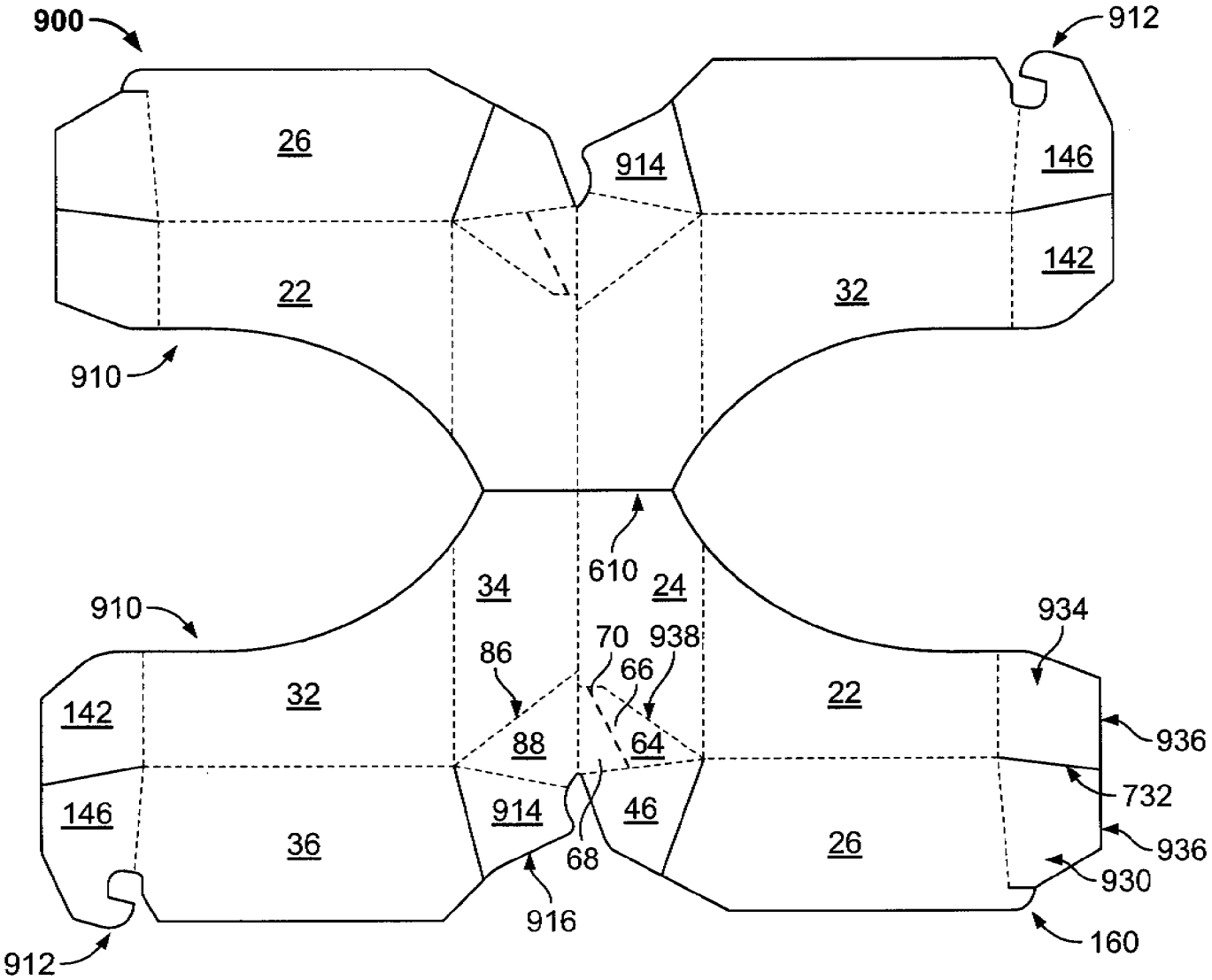
FIG. 17 is a top plan view of a blank of sheet material for constructing a tandem unit of two food holders according to a fourth alternative embodiment of this invention.
Figure 18:
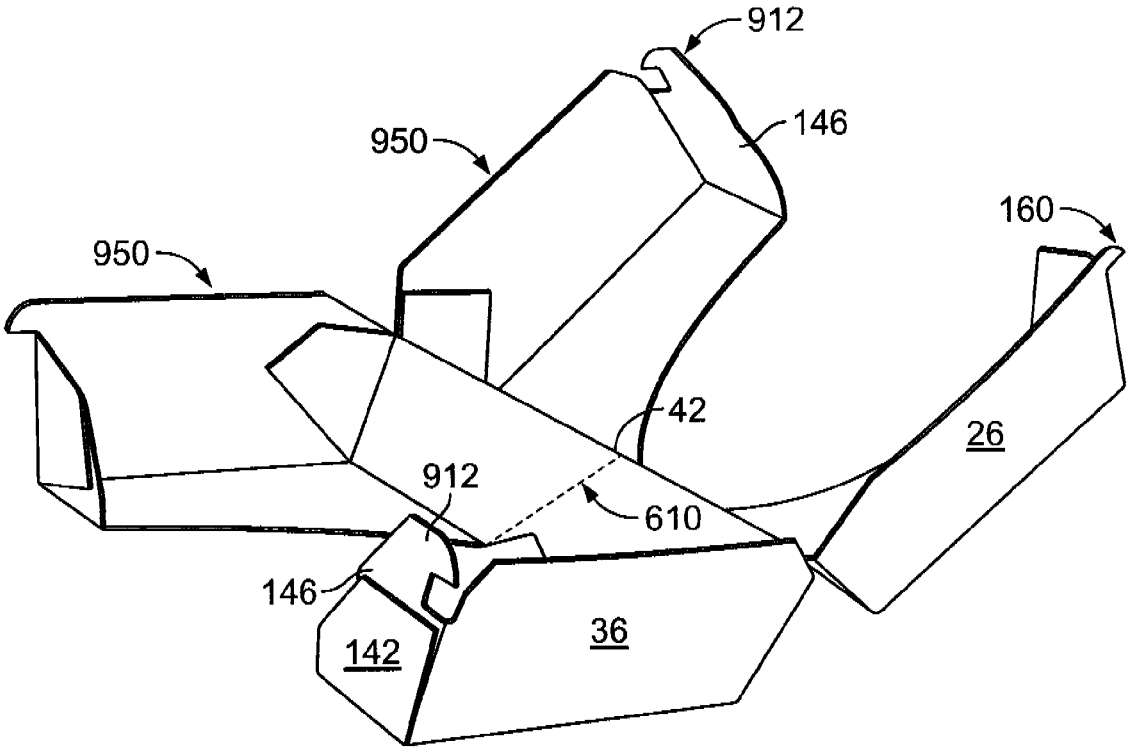
FIG. 18 is a perspective view of a tandem unit of two food holders constructed from the blank in FIG. 17.
Figure 19:
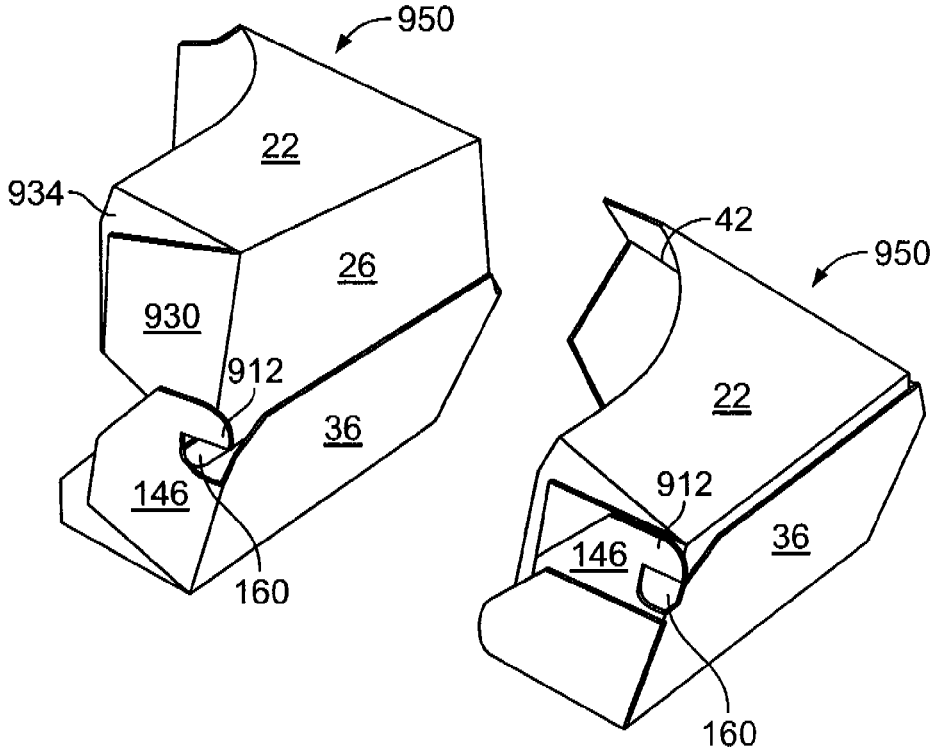
FIG. 19 is a perspective view of the two food holders shown in FIG. 18.

FIG. 17 illustrates a top plan view of a blank of sheet material for constructing a tandem unit of two food holders according to a fourth alternative embodiment of this invention. Specifically, FIG. 17 is a top plan view of blank of sheet material 900 for constructing a tandem unit of two food holders 950 according to a fourth alternative embodiment of this invention. FIG. 18 is a perspective view of food holders 950 constructed from blank 900 shown in an assembled, open configuration. FIG. 19 is another perspective view of food holders 950 constructed from blank 900 shown in an assembled, closed configuration.

Blank 900 is similar to blank 800 of FIG. 14, and like components are identified with like reference numerals. In contrast to FIG. 14, flap 146 does not include cutout portion 162. Rather, bottom flap 146 includes a hook portion 912 defined along a periphery of bottom flap 146. Hook portion 912 is configured to engage locking tab 160 such that hook portion 912 and locking tab 160 connect and lock to one another.

Moreover, in contrast to FIG. 14, blank 900 does not include glue flap 82. Rather, blank 900 includes a glue flap 914 partially defined by an arcuate edge 916. Additionally, blank 900 does not include flaps 730 and 734. Rather, blank 900 includes panels 930 and 934 wherein panels 930 and 934 are substantially similar size and share an outer periphery edge 936. Furthermore, panel 64 of blank 900 is substantially triangular and is defined at least partially by slightly arcuate fold line 938.

Each individual unit 910 is formed into a food holder 950. Food holder 950 is formed in a similar manner to food holder 850.

Figure 20:
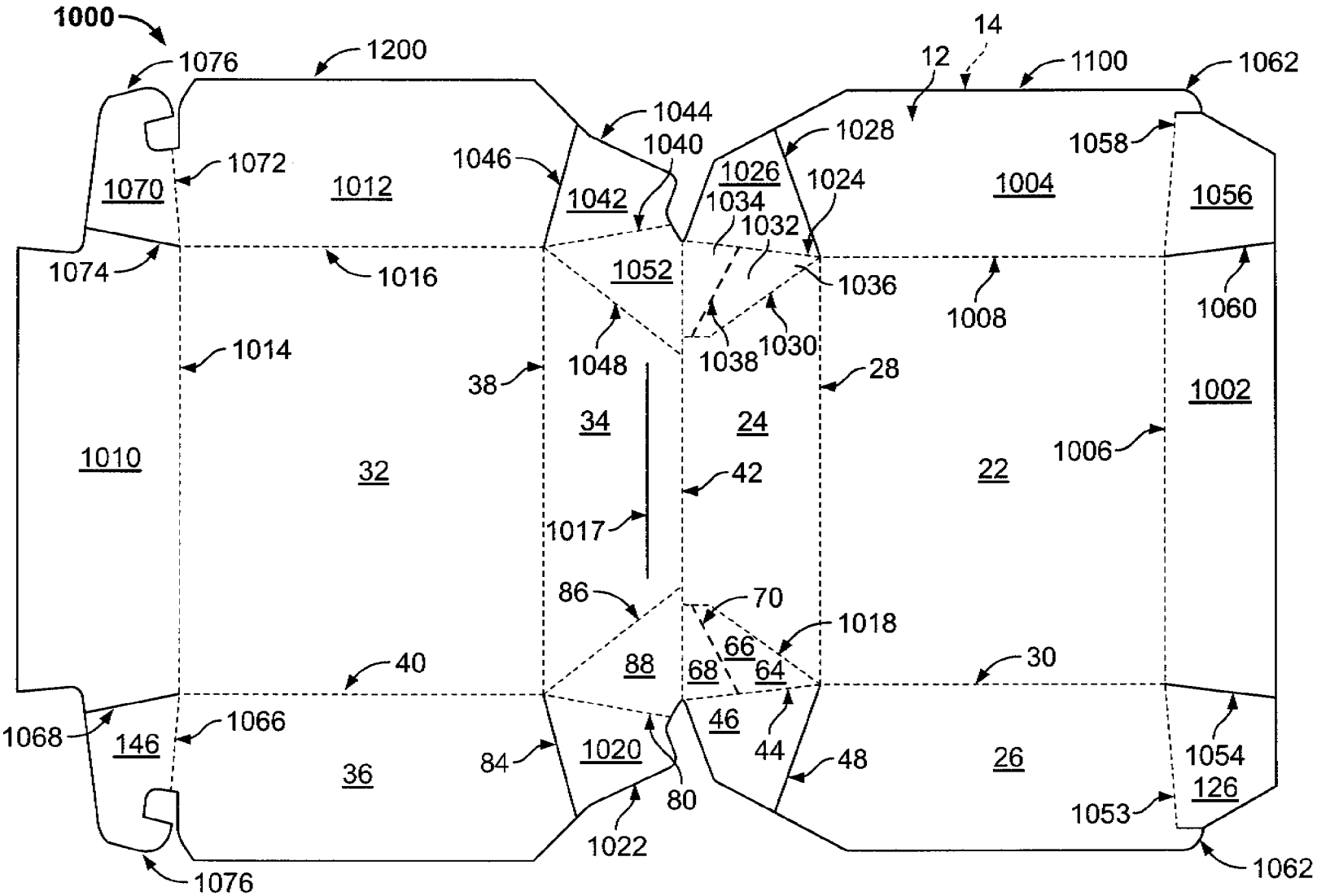
FIG. 20 is a top plan view of a blank of sheet material for constructing a food holder according to a fifth alternative embodiment of this invention.
Figure 21:
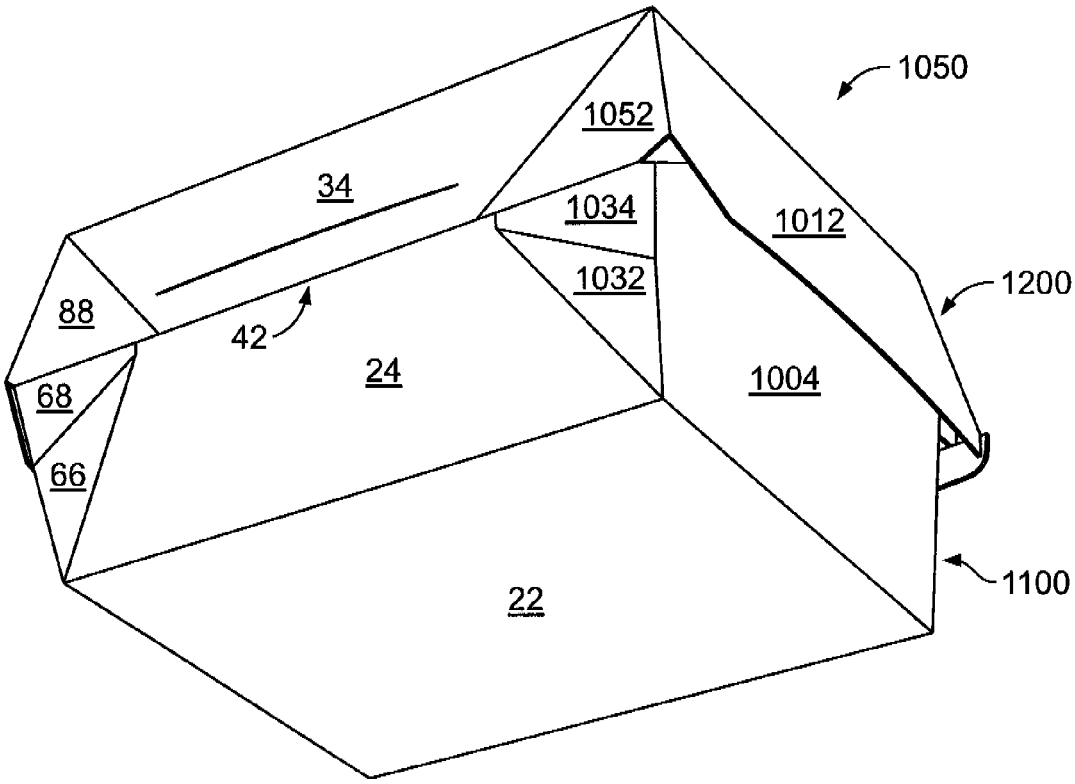
FIG. 21 is a perspective view of a food holder constructed from the blank shown in FIG. 20.
Figure 22:
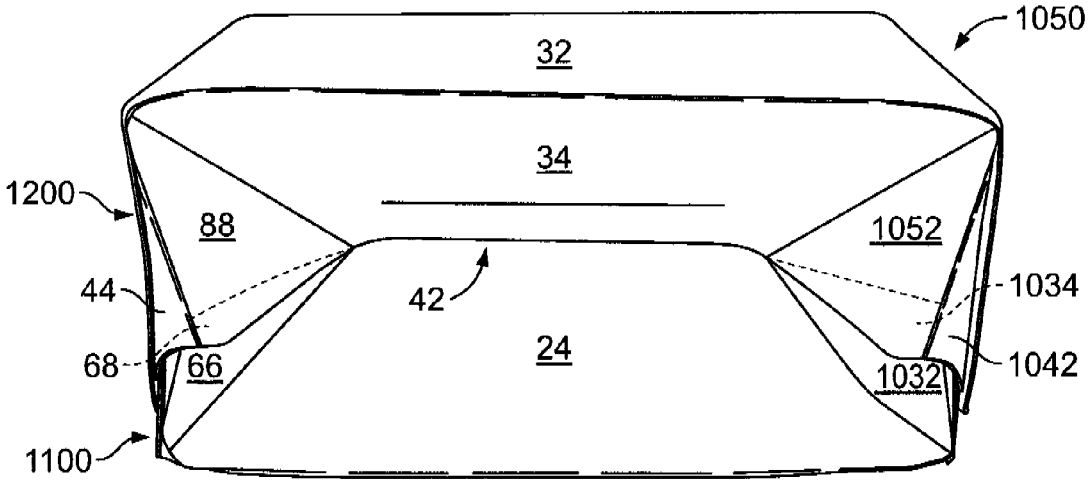
FIG. 22 is another perspective view of the food holder shown in FIG. 20.

FIG. 20 illustrates a top plan view of a blank of sheet material 1000 for constructing a food holder 1050 according to a fifth alternative embodiment of this invention. Specifically, FIG. 20 is a top plan view of blank of sheet material 1000 for constructing a food holder 1050 according to fifth alternative embodiment of this invention. FIGS. 21 and 22 are perspective views of food holder 1050 constructed from blank 1000 shown in an assembled, closed configuration.

Referring to FIG. 20, blank 1000 includes interior surface 12 and opposing exterior surface 14. In the exemplary embodiment, blank 1000 includes top tray center panel 22, first side panel 24, an opposing side panel 1002, first end panel 26, and an opposing end panel 1004. First side panel 24 and opposing side panel 1002 are coupled to top tray center panel 22 by preformed fold lines 28 and 1006, respectively. Specifically, first side panel 24 extends from top tray center panel 22 along respective fold line 28 and side panel 1002 extends from top tray center panel 22 along respective fold line 1006. Similarly, first end panel 26 and end panel 1004 are coupled to top tray center panel 22 by preformed fold lines 30 and 1008, respectively. Similarly, first end panel 26 extends from top tray center panel 22 along respective fold line 30, and end panel 1004 extends from top tray center panel 22 along respective fold line 1008.

Blank 1000 also includes bottom tray center panel 32, second side panel 34, an opposing side panel 1010, second end panel 36, and an opposing end panel 1012. Second side panel 34 and opposing side panel 1010 are coupled to bottom tray center panel 32 by preformed fold lines 38 and 1014, respectively. Specifically, second side panel 34 extends from bottom tray center panel 32 along respective fold line 38 and side panel 1010 extends from bottom tray center panel 32 along respective fold line 1014. Similarly, second end panel 36 and end panel 1012 are coupled to bottom tray center panel 32 by preformed fold lines 40 and 1016, respectively. Similarly, second end panel 36 extends from bottom tray center panel 32 along respective fold line 30, and end panel 1012 extends from bottom tray center panel 32 along respective fold line 1016. Moreover, second side panel 34 includes an area of relief 1017 parallel to hinge line 42.

Second side panel 34 is hingedly coupled to first side panel 24 by hinge line 42. Hinge line 42 is substantially parallel to fold lines 28, 38, 1006, and 1014.

First side panel 24 is defined by fold line 44 which forms one edge of glue flap 46. Glue flap 46 is further defined by cut line 48 which separates glue flap 46 from end panel 26. A fold line 1018 along with fold line 44 and hinge line 42, create triangular panel 64 within first side panel 24. In one embodiment, fold line 1018 includes a slightly arcuate section. Triangular panel 64 is further divided into two triangular panels 66 and 68 by fold line 70. Fold line 70 extends from an intersection formed by fold line 1018 and hinge line 42 to fold line 44.

Moreover, first side panel 24 further includes fold line 1024 which forms one edge of a glue flap 1026. Glue flap 1026 is further defined by a cut line 1028 which separates glue flap 1026 from end panel 1004. A fold line 1030 along with fold line 1024 and hinge line 42, create a triangular panel 1032 within first side panel 24. In one embodiment, fold line 1030 includes a slightly arcuate section. Triangular panel 1032 is further divided into two triangular panels 1034 and 1036 by a fold line 1038. Fold line 1038 extends from an intersection, formed by fold line 1030 and hinge line 42, to fold line 1024. Triangular panels 64 and 88, along with fold lines 44, 80, 86, and 1018, define a first moveable section of food holder 1050. When food holder 1050 is formed, this first moveable section, which includes fold line 70, enables a user using food holder 1050 to more securely hold a food product and facilitates discharge of the food product from food holder 1050.

Second side panel 34 is defined by fold line 80 which forms one edge of a glue flap 1020. Glue flap 1020 includes an arcuate periphery 1022 and is further defined by cut line 84 which separates glue flap 1020 from end panel 36. Second side panel 34 further includes fold line 86. Fold lines 86 and 80, along with hinge line 42, create triangular panel 88 within second side panel 34. Triangular panels 64 and 88, along with fold lines 44, 80, 86, and 1018, define a moveable section of food holder 1050. When food holder 1050 is formed, this moveable section, which includes fold line 70, enables a user using food holder 1050 to more securely hold a food product and facilitates discharge of the food product from food holder 1050.

Moreover, second side panel 34 is further defined by a fold line 1040 which forms one edge of a glue flap 1042. Glue flap 1042 includes an arcuate periphery 1044 and is further defined by a cut line 1046 which separates glue flap 1042 from end panel 1012. Second side panel 34 further includes fold line 1048. Fold lines 1040 and 1048, along with hinge line 42, create a triangular panel 1052 within second side panel 34. Triangular panels 1032 and 1052, along with fold lines 1024, 1040, 1048, and 1030, define a second moveable section of food holder 1050. When food holder 1050 is formed, this second moveable section, which includes fold line 1038, enables a user using food holder 1050 to more securely hold a food product and facilitates discharge of the food product from food holder 1050.

As shown in FIG. 20, a top portion 1100 and bottom portion 1200 are connected along hinge line 42. More specifically, first side panel 24 and second side panel 34 are hingedly connected at hinge line 42.

Top tray center panel 22 includes glue flap 126. Glue flap 126 extends from end panel 26 along a fold line 1053. Fold line 1053 extends from and is substantially coaxial with fold line 1006. Glue flap 126 also extends from side panel 1002 along a cut line 1054. Fold line 1053, along with cut line 1054, define the edges of glue flap 126. Similarly, top tray center panel 22 also includes a glue flap 1056. Glue flap 1056 extends from end panel 1004 along a fold line 1058. Fold line 1058 extends from and is substantially coaxial with fold line 1006. Glue flap 1056 also extends from side panel 1002 along a cut line 1060. Fold line 1058, along with cut line 1060, define edges of glue flap 1056. As shown in FIG. 20, end panels 26 and 1004 each include a locking tab 1062.

Similarly, bottom tray center panel 32 includes flap 146 that extends from end panel 36 along a fold line 1066. Fold line 1066 extends from and is substantially coaxial with fold line 1014. Flap 146 also extends from side panel 1010 along a cut line 1068. Fold line 1066, along with cut line 1068, define the edges of flap 146. Similarly, bottom tray center panel 32 also includes a glue flap 1070. Glue flap 1070 extends from end panel 1012 along a fold line 1072. Fold line 1072 extends from and is substantially coaxial with fold line 1014. Glue flap 1070 also extends from side panel 1010 along a cut line 1074. Fold line 1072, along with cut line 1074, define edges of glue flap 1070.

As shown in FIG. 20, each flap 146 and 1070 includes a hook portion 1076. Each hook portion 1076 is defined along a periphery of flaps 146 and 1070. Hook portion 1076 is configured to engage locking tabs 1062 such that hook portion 1076 and locking tab 1062 connect and lock to one another.

When food holder 1050 is formed, and top portion 1100 is rotated about hinge line 42, hook portion 1076 is configured to receive locking tab 1062. Once locking tab 1062 is coupled to hook portion 1076, top portion 1100 is coupled or releasably locked to bottom portion 1200 and food holder 1050 will remain in a closed configuration such that food holder 1050 is extended around the food product.

In the exemplary embodiment, food holder 1050 is constructed from blank 1000 for holding food to ease consumption. Food holder 1050 is formed from blank 1000 by folding blank 1000 about the fold lines. In one embodiment, an adhesive material is applied to portions of blank 1000 to secure selected portions of food holder 1050 together.

FIG. 21 is a perspective view of a constructed food holder 1050. Constructed food holder 1050 defines an enclosed area within which a food product can be placed. FIG. 22 is another perspective view of food holder 1050.

Referring back to FIG. 20, to create top portion 1100 of formed food holder 1050, glue flap 126 is rotated about fold line 1053, flap 1056 is rotated about fold line 1058, flap 46 is rotated about fold line 44, and flap 1026 is rotated about fold line 1024. Moreover, panel 26 is rotated about fold line 30, panel 1004 is rotated about fold line 1008, panel 1002 is rotated about fold line 1006, and panel 24 is rotated about fold line 28. Once these folds are complete, the interior surface of panel 1002 is placed in contact with and adhesively coupled to the exterior surfaces of glue flaps 126 and 1056. Also, the interior surface of panel 1004 is placed in contact with and adhesively coupled to the exterior surface of flap 1026, and the interior surface of first end panel 26 is placed in contact with and adhesively coupled to the exterior surface of flap 46. This forms top portion 1100 of food holder 1050. In another embodiment, exterior surface of panel 1002 is placed in contact with and adhesively coupled to the interior surfaces of flaps 126 and 1056.

Bottom portion 1200 is formed in a similar manner to top portion 1100. To create bottom portion 1200 of formed food holder 1050, flap 146 is rotated about fold line 1066, flap 1070 is rotated about fold line 1072, flap 1020 is rotated about fold line 80, and flap 1042 is rotated about fold line 1040. Moreover, panel 36 is rotated about fold line 40, panel 1012 is rotated about fold line 1016, panel 1010 is rotated about fold line 1014, and panel 34 is rotated about fold line 38. Once these folds are complete, the interior surface of panel 1010 is placed in contact with and adhesively coupled to the exterior surfaces of flaps 146 and 1070. Also, the interior surface of panel 1012 is placed in contact with and adhesively coupled to the exterior surface of flap 1042, and the interior surface of panel 36 is placed in contact with and adhesively coupled to the exterior surface of flap 1020. This forms bottom portion 1200 of food holder 1050. In another embodiment, exterior surface of panel 1010 is placed in contact with and adhesively coupled to the interior surfaces of flaps 146 and 1070.

As shown in FIGS. 21 and 22, food holder 1050 is shown in a closed configuration. Specifically, to rotate food holder 1050 from an open configuration to the closed configuration, top portion 1100 is rotated about hinge line 42 towards bottom portion 1200 and hook portions 1076 engage tabs 1062 to releasably couple top portion 1100 to bottom portion 1200. Moreover, a portion of panel 1010 overlaps a portion of panel 1002 when food holder 1050 is in the closed configuration.

In operation, food holder 1050 is used in a similar manner to that of food holder 200. Specifically, the user squeezes panel 22 towards bottom panel 32, the moveable section allows the distance between panel 22 and panel 32 to decrease. When panel 22 is moved towards panel 32, fold line 70 allows triangular panel 66 to translate towards the interior of food holder 1050, and more specifically, allows triangular panel 68 to rotate about hinge line 42 until fold line 70 and interior surface 12 of triangular panel 68 comes into contact in a face-to-face relationship with the interior surface of triangular panel 88, and fold line 70 and triangular panel 68 are on the opposite side of hinge line 42 as previously located. Furthermore, when triangular panel 68 is rotated about hinge line 42, exterior surface 14 of triangular panel 68 comes into contact in a face-to-face relationship with exterior surface 14 of triangular panel 66. In addition to allowing food holder 1050 to better conform to the food product, the translation of panel 66 toward panel 88 via panel 68 also facilitates the discharge of the food product out of food holder 200. Triangular panels 66, 68, and 88 may be formed in any shape so long as the shape allows food holder 200 to better conform to the food product and facilitates the discharge of the food product out of food holder 200.

Similarly, in operation, when panel 22 is moved towards panel 32, fold line 1038 allows triangular panel 1032 to translate towards the interior of food holder 1050, and more specifically, allows triangular panel 1034 to rotate about hinge line 42 until fold line 1038 and interior surface 12 of triangular panel 1034 comes into contact in a face-to-face relationship with the interior surface of triangular panel 1052, and fold line 1038 and triangular panel 1034 are on the opposite side of hinge line 42 as previously located. Furthermore, when triangular panel 1034 is rotated about hinge line 42, exterior surface 14 of triangular panel 1034 comes into contact in a face-to-face relationship with exterior surface 14 of triangular panel 1032. In addition to allowing food holder 1050 to better conform to the food product, the translation of panel 1032 toward panel 1052 via panel 1034 also facilitates the discharge of the food product out of food holder 1050. Triangular panels 1032, 1034, and 1052 may be formed in any shape so long as the shape allows food holder 1050 to better conform to the food product and facilitates the discharge of the food product out of food holder 1050.

The above-described food holder and method of constructing the food holder provides a food holder that is easily constructed from a flexible unitary blank of paperboard. Moreover, the food holder is configured to be placed within a container. The food holder includes a moveable section within a portion of the food holder to improve the use of the food holder such that the food holder better conforms to the food product and facilitates the discharge of the food product out of the food holder.

Exemplary embodiments of a food holder have been described above in detail. The food holder is not limited to the specific embodiments described herein, but rather, components of the food holder and/or steps of the method may be utilized independently and separately from other components and/or steps described herein. Further, the described components and/or method steps can also be defined in, or used in combination with, other apparatus and/or methods, and are not limited to practice with only the apparatus and method as described herein.

While the invention has been described in terms of various specific embodiments, those skilled in the art will recognize that the invention can be practiced with modification within the spirit and scope of the claims.

What is claimed is:

1. A food holder for retaining a food product, the food holder is formed from a continuous blank of sheet material, the food holder comprising:

a top tray including a center panel, a side panel, and an end panel coupled together along a plurality of fold lines;

a bottom tray including a center panel, a side panel, and an end panel coupled together along a plurality of fold lines, the bottom tray rotatably coupled to the top tray along a hinge line, the top tray rotatable relative to the bottom tray from an open position to a closed position; and a moveable section including a portion of at least one of the top tray side panel and the bottom tray side panel, the moveable section facilitates movement of the top tray relative to the bottom tray for retaining the food product, and the moveable section includes at least one triangular panel defined within a portion of at least one of the top tray side panel and the bottom tray side panel, wherein the at least one triangular panel is at least partially defined by a first oblique fold line that extends obliquely relative to the hinge line, the first oblique fold line extends toward an intermediate portion of the hinge line, the hinge line has opposite ends, and the intermediate portion of the hinge line is positioned between, and distant from each of, the opposite ends of the hinge line;

wherein the moveable section further comprises a first glue flap extending from the top tray side panel along a second oblique fold line and configured to couple to a portion of the top tray end panel, and a second glue flap extending from the bottom tray side panel along a third oblique fold line and configured to couple to a portion of the bottom tray end panel;

each of the second and third oblique fold lines extends obliquely relative to the hinge line.

2. A food holder in accordance with claim 1 wherein:

the at least one triangular panel comprises two triangular panels of the moveable section, the two triangular panels are separated by the hinge line, the two triangular panels include a first triangular panel defined within a portion of the top tray side panel and a second triangular panel defined within a portion of the bottom tray side panel, and the hinge line foldably connects the first triangular panel to the second triangular panel.

3. A food holder in accordance with claim 1 wherein the top tray further comprises a locking tab formed within a portion of the top tray end panel and the bottom tray further comprises a hook portion formed within a portion of the second glue flap, the locking tab is configured to engage the hook portion such that the top tray is removably coupled to the bottom tray in the closed position.

4. A food holder in accordance with claim 1 wherein the top tray further comprises a locking tab formed within a portion of the top tray end panel and the bottom tray further comprises a cutout portion formed within a portion of the bottom tray end panel, the locking tab is configured to engage the cutout portion such that the top tray is to removably coupled to the bottom tray in the closed position.

5. A food holder in accordance with claim 1 wherein the food holder includes a pair of tear lines extending across a portion of the top tray center panel and the bottom tray center panel such that the tear lines are configured to facilitate gaining access to the food pro duct.

6. A food holder in accordance with claim 1 wherein the top tray side panel is coupled to the top tray center panel along a top tray perforated tear line and the bottom tray side panel is coupled to the bottom tray center panel along a bottom tray perforated tear line such that the top tray side panel and the bottom tray side panel are configured to separate from the top tray center panel and the bottom tray center panel.

7. A food holder in accordance with claim 1 in combination with a tray carton formed from a second continuous blank of sheet material, wherein the tray carton is configured to receive at least one of the top tray and the bottom tray.

8. A combination in accordance with claim 7 wherein the tray carton is configured to receive at least one of the top tray and the bottom tray such that the at least one of the top tray and the bottom tray is positioned adjacent to the tray carton.

9. A combination in accordance with claim 7 wherein the tray carton is a clamshell container having a top portion and a bottom portion extending from the top portion along a second hinge line, the top portion is configured to receive the top tray wherein the top tray is positioned adjacent the top portion, the bottom portion is configured to receive the bottom tray wherein the bottom tray is positioned adjacent the bottom portion, and the second hinge line is aligned with the hinge line.

10. A combination in accordance with claim 9 wherein the food holder assembly is rotated between an open configuration and a closed configuration such that the top portion is rotated towards the bottom portion along the second hinge line and the top tray is simultaneously rotated towards the bottom tray along the hinge line.

11. The food holder of claim 1 wherein the food holder is sized to be received within a container that surrounds an entirety of the food product and food holder.

12. The food holder of claim 1 wherein the food holder is sized to conform to the shape of the food product.

13. The food holder of claim 1 wherein the food holder facilitates discharge of the food product out of the food holder.

14. A food holder in accordance with claim 1 wherein the at least one triangular panel is at least partially defined by the hinge line, the first oblique fold line is defined within the at least one of the top tray side panel and the bottom tray side panel, and the first oblique fold line is proximate the hinge line.

15. A food holder in accordance with claim 1 wherein the first oblique fold line extends outwardly from the intermediate portion of the hinge line.

16. A food holder in accordance with claim 1 wherein the second oblique fold line foldably connects the first glue flap to the first triangular panel.

17. A food holder for retaining a food product, the food holder is formed from a continuous blank of sheet material, the food holder comprising:

a top tray including a center panel, a side panel, and an end panel coupled together along a plurality of fold lines;

a bottom tray including a center panel, a side panel, and an end panel coupled together along a plurality of fold lines, the bottom tray rotatably coupled to the top tray along a hinge line, the top tray rotatable relative to the bottom tray from an open position to a closed position; and a moveable section including a portion of at least one of the top tray side panel and the bottom tray side panel, the moveable section facilitates movement of the top tray relative to the bottom tray for retaining the food product, and the moveable section includes at least one triangular panel defined within a portion of at least one of the top tray side panel and the bottom tray side panel, wherein the at least one triangular panel is at least partially defined by an oblique fold line that extends obliquely relative to the hinge line, the oblique fold line extends toward an intermediate portion of the hinge line, the hinge line has opposite ends, and the intermediate portion of the hinge line is positioned between, and distant from each of, the opposite ends of the hinge line, wherein:

the top tray and the bottom tray in the closed position form a cavity wherein the cavity is sized to receive the food product, the top and bottom trays cooperate with one another to together define an opening to the cavity so that said opening is defined through both the top tray and the bottom tray, and said opening is configured for having a portion of the food product project through said opening.

18. A food holder in accordance with claim 17 wherein the moveable section is moveable from a first configuration to a second configuration when the top tray and the bottom tray are moved towards one another, wherein the hinge line moves away from the cavity and the side panels rotate about the hinge line when the moveable section moves from the first configuration to the second configuration.

19. A food holder in accordance with claim 17 wherein while the top tray is in a closed position, said opening is at least partially defined by:

an edge of the top tray center panel, an edge of the top tray side panel, an edge of the bottom tray center panel, and an edge of the bottom tray side panel.

20. A food holder for retaining a food product, the food holder is formed from a continuous blank of sheet material, the food holder comprising:

a top tray including a center panel, a side panel, and an end panel coupled together along a plurality of fold lines;

a bottom tray including a center panel, a side panel, and an end panel coupled together along a plurality of fold lines, the bottom tray rotatably coupled to the top tray along a hinge line, the top tray rotatable relative to the bottom tray from an open position to a closed position, wherein the top tray and the bottom tray in the closed position form a cavity that is sized to receive the food product; and a moveable section including a portion of at least one of the top tray side panel and the bottom tray side panel, the moveable section facilitates movement of the top tray relative to the bottom tray for retaining the food product, wherein the moveable section is moveable from a first configuration to a second configuration when the top tray and the bottom tray are moved towards one another, the hinge line moves away from the cavity and the side panels rotate about the hinge line when the moveable section moves from the first configuration to the second configuration, and the moveable section includes three adjacent triangular panels coupled together along a plurality of fold lines, the three adjacent triangular panels include a first triangular panel defined within a portion of the top tray side panel, a second triangular panel defined within a portion of the bottom tray side panel, and a third triangular panel defined within a portion of the top tray side panel, the second and third triangular panels are separated by the hinge line, the first and third triangular panels are separated by a fold line that extends away from the hinge line, each of the three adjacent triangular panels includes an interior surface and an exterior surface.

21. A food holder in accordance with claim 20 wherein the moveable section moves from the first configuration to the second configuration by: moving the top tray and the bottom tray toward each other causing the third triangular panel to rotate inwardly towards the cavity such that the exterior surface of the third triangular panel is in a face-to-face relationship with the exterior surface of the first triangular panel when the moveable section is in the second configuration, and the interior surface of the third triangular panel is in a face-to-face relationship with the interior surface of the second triangular panel when the moveable section is in the second configuration, the moveable section conforms to the food product and facilitates the discharge of the food product from the food holder.

22. A food holder for retaining a food product, the food holder is formed from a continuous blank of sheet material, the food holder comprising:

a top tray including a center panel, a side panel, and an end panel coupled together along a plurality of fold lines;

a bottom tray including a center panel, a side panel, and an end panel coupled together along a plurality of fold lines, the bottom tray being rotatably coupled to the top tray along a hinge line, so that the top tray is rotatable about the hinge line relative to the bottom tray from an open position to a closed position, wherein while the top tray is in the closed position, simultaneously a cavity is defined by and between the top and bottom trays for receiving the food product, and the top and bottom trays cooperate with one another to together define an opening to the cavity so that said opening is defined through both the top tray and the bottom tray, the top tray partially defines said opening, the bottom tray partially defines said opening, said opening is positioned between the top and bottom trays, and said opening is for having a portion of the food product project through said opening while the top tray is in the closed position; and a moveable section including a portion of at least one of the top tray side panel and the bottom tray side panel, the moveable section being adapted for facilitating, while the top tray is in and remains in the closed position, movement of the top tray relative to the bottom tray, for retaining the food product.

23. A food holder in accordance with claim 22 wherein while the top tray is in and remains in the closed position:

the moveable section is moveable from a first configuration to a second configuration when the top tray and the bottom tray are moved towards one another, and the hinge line moves away from the cavity and the side panels rotate about the hinge line when the moveable section moves from the first configuration to the second configuration.

24. A food holder in accordance with claim 22 wherein while the top tray is in the closed position, said opening is at least partially defined by:

an edge of the top tray center panel, an edge of the top tray side panel, an edge of the bottom tray center panel, and an edge of the bottom tray side panel.

25. A food holder for retaining a food product, the food holder is formed from a continuous blank of sheet material, the food holder comprising:

a top tray including a center panel, a side panel, and an end panel coupled together along a plurality of fold lines;

a bottom tray including a center panel, a side panel, and an end panel coupled together along a plurality of fold lines, the bottom tray being rotatably coupled to the top tray along a hinge line, so that the top tray is rotatable about the hinge line relative to the bottom tray from an open position to a closed position, wherein while the top tray is in the closed position, simultaneously a cavity is defined by and between the top and bottom trays for receiving the food product, and the top and bottom trays cooperate with one another to together define an opening to the cavity, so that the top tray partially defines said opening, the bottom tray partially defines said opening, said opening is positioned between the top and bottom trays, and said opening is for having a portion of the food product project through said opening while the top tray is in the closed position; and a moveable section including a portion of at least one of the top tray side panel and the bottom tray side panel, the moveable section being adapted for facilitating, while the top tray is in and remains in the closed position, movement of the top tray relative to the bottom tray, for retaining the food product, wherein the moveable section includes three adjacent triangular panels coupled together along a plurality of fold lines, the three adjacent triangular panels include a first triangular panel defined within a portion of the top tray side panel, a second triangular panel defined within a portion of the bottom tray side panel, and a third triangular panel defined within a portion of the top tray side panel, the second and third triangular panels are separated by the hinge line, the first and third triangular panels are separated by a fold line that extends away from the hinge line, each of the three adjacent triangular panels includes an interior surface and an exterior surface.

26. A food holder for retaining a food product, the food holder is formed from a continuous blank of sheet material, the food holder comprising:

a top tray including a center panel, a side panel, and an end panel coupled together along a plurality of fold lines;

a bottom tray including a center panel, a side panel, and an end panel coupled together along a plurality of fold lines, the bottom tray being rotatably coupled to the top tray along a hinge line, so that the top tray is rotatable about the hinge line relative to the bottom tray from an open position to a closed position, wherein while the top tray is in the closed position, simultaneously a cavity is defined by and between the top and bottom trays for receiving the food product, and the top and bottom trays cooperate with one another to together define an opening to the cavity, so that the top tray partially defines said opening, the bottom tray partially defines said opening, said opening is positioned between the top and bottom trays, and said opening is for having a portion of the food product project through said opening while the top tray is in the closed position, wherein said opening, which is defined while the top tray is in the closed position, is at least partially defined by an edge of the top tray center panel, an edge of the top tray side panel, an edge of the bottom tray center panel, and an edge of the bottom tray side panel; and a moveable section including a portion of at least one of the top tray side panel and the bottom tray side panel, the moveable section being adapted for facilitating, while the top tray is in and remains in the closed position, movement of the top tray relative to the bottom tray, for retaining the food product.

27. A food holder in accordance with claim 26 wherein the moveable section includes at least one triangular panel defined within a portion of at least one of the top tray side panel and the bottom tray side panel.

28. A food holder in accordance with claim 27 wherein the at least one triangular panel is at least partially defined by the hinge line and an oblique fold line, the oblique fold line is defined within the at least one of the top tray side panel and the bottom tray side panel, the oblique fold line extends obliquely relative to the hinge line, and the oblique fold line is proximate the hinge line.

29. A food holder in accordance with claim 26 wherein the moveable section includes two triangular panels that are separated by and at least partially defined by the hinge line, the two triangular panels include a first triangular panel defined within a portion of the top tray side panel and a second triangular panel defined within a portion of the bottom tray side panel.

30. A food holder in accordance with claim 26 wherein the food holder includes a pair of tear lines extending across a portion of the top tray center panel and the bottom tray center panel such that the tear lines are configured to facilitate gaining access to the food product.

31. A food holder in accordance with claim 26 wherein the top tray side panel is coupled to the top tray center panel along a top tray perforated tear line and the bottom tray side panel is coupled to the bottom tray center panel along a bottom tray perforated tear line such that the top tray side panel and the bottom tray side panel are configured to separate from the top tray center panel and the bottom tray center panel.

* * * * *

UNITED STATES PATENT AND TRADEMARK OFFICE

CERTIFICATE OF CORRECTION

PATENT NO. : 8,820,621 B2
APPLICATION NO. : 11/690445
DATED : September 2, 2014
INVENTOR(S) : Bradley John Burke and Rachel K. Mortenson It is certified that error appears in the above-identified patent and that said Letters Patent is hereby corrected as shown below:

Title Page, Item (73) Assignee, add

-- Havi Global Solutions LLC, Downer's Grove, IL (US) --

Signed and Sealed this
Twenty-eighth Day of June, 2016

Michelle K. Lee

Michelle K. Lee
*Director of the United States Patent and Trademark Office*